US009467772B2

(12) United States Patent
Ekedahl

(10) Patent No.: US 9,467,772 B2
(45) Date of Patent: Oct. 11, 2016

(54) ACOUSTICAL SIGNAL GENERATOR USING TWO TRANSDUCERS AND A REFLECTOR WITH A NON-FLAT CONTOUR

(75) Inventor: Olle Ekedahl, Hagersten (SE)

(73) Assignee: KPO INNOVATION AB, Arsta (SE)

( * ) Notice: Subject to any disclaimer, the term of this patent is extended or adjusted under 35 U.S.C. 154(b) by 0 days.

(21) Appl. No.: 14/232,090

(22) PCT Filed: Jul. 10, 2012

(86) PCT No.: PCT/SE2012/050825
§ 371 (c)(1),
(2), (4) Date: Jan. 10, 2014

(87) PCT Pub. No.: WO2013/012384
PCT Pub. Date: Jan. 24, 2013

(65) Prior Publication Data

US 2014/0198941 A1 Jul. 17, 2014

(30) Foreign Application Priority Data

Jul. 15, 2011 (SE) ..... 1150707

(51) Int. Cl.

| | |
|---|---|
| ***H04R 1/34*** | (2006.01) |
| ***H04R 1/40*** | (2006.01) |
| ***H04R 1/02*** | (2006.01) |
| ***H04R 1/32*** | (2006.01) |
| *H04R 1/28* | (2006.01) |
| *H04R 1/30* | (2006.01) |

(52) U.S. Cl.
CPC ..... *H04R 1/345* (2013.01); *H04R 1/02* (2013.01); *H04R 1/323* (2013.01); *H04R 1/403* (2013.01); *H04R 1/2896* (2013.01); *H04R 1/30* (2013.01)

(58) Field of Classification Search
None
See application file for complete search history.

(56) References Cited

U.S. PATENT DOCUMENTS 1,786,279 A * 12/1930 Wolff ..... H04R 1/345 181/155
2,732,907 A * 1/1956 Leon ..... G10K 11/28 181/175
3,326,321 A * 6/1967 Valuch ..... H04R 1/345 181/144
3,500,953 A * 3/1970 Lahti ..... H04R 1/26 181/151
3,816,672 A * 6/1974 Gefvert ..... H04R 1/345 181/144
3,912,866 A * 10/1975 Fox ..... H04R 1/2865 181/155

(Continued)

FOREIGN PATENT DOCUMENTS

CN 11585835 A 9/1997
EP 0725540 8/1996

(Continued)

OTHER PUBLICATIONS

"Loudspeaker", Wikipedia http://en.wikipedia.org/wiki/Loudspeaker_enclosure.

(Continued)

*Primary Examiner* — Fan Tsang
*Assistant Examiner* — Angelica M McKinney
(74) *Attorney, Agent, or Firm* — Knobbe, Martens, Olson & Bear, LLP

(57) ABSTRACT

The present invention relates to an audio generator comprising, a first and a second transducer element, and the first transducer element has a first membrane having a surface which is non-flat, and a reflector, wherein the reflector has a surface with a non-flat contour and the reflector co-operating with directive guiding walls so as to lead and guide audio pressure waves to propagate in predetermined directions.

35 Claims, 18 Drawing Sheets

(56) References Cited

U.S. PATENT DOCUMENTS

| | | | | |
|---|---|---|---|---|
| 4,008,374 | A | 2/1977 | Tiefenbrun | |
| 4,184,562 | A | 1/1980 | Bakamjian | |
| 4,325,454 | A * | 4/1982 | Humphrey | H04R 1/2819 181/145 |
| 4,348,549 | A * | 9/1982 | Berlant | 381/99 |
| 4,718,517 | A | 1/1988 | Carlson | |
| 4,836,329 | A * | 6/1989 | Klayman | 181/155 |
| 4,907,671 | A * | 3/1990 | Wiley | 181/155 |
| 4,923,031 | A | 5/1990 | Carlson | |
| 5,115,882 | A * | 5/1992 | Woody | 181/144 |
| 5,144,670 | A * | 9/1992 | Negishi | 381/304 |
| 5,374,124 | A * | 12/1994 | Edwards | H04R 1/24 181/145 |
| 5,418,336 | A * | 5/1995 | Negishi et al. | 181/155 |
| 5,446,792 | A * | 8/1995 | Sango | 381/160 |
| 5,485,521 | A * | 1/1996 | Yagisawa | H04R 1/345 181/155 |
| 5,525,767 | A | 6/1996 | Fields | |
| 5,721,401 | A | 2/1998 | Sim | |
| 5,886,304 | A * | 3/1999 | Schlenzig | F21V 33/0056 181/153 |
| 5,898,137 | A | 4/1999 | Saito | |
| 5,995,634 | A | 11/1999 | Zwolski | |
| 6,062,338 | A | 5/2000 | Thompson | |
| 6,257,365 | B1 * | 7/2001 | Hulsebus, II | 181/155 |
| 6,820,718 | B2 * | 11/2004 | LaCarrubba | 181/155 |
| 6,863,152 | B1 * | 3/2005 | Sahyoun | H04R 7/20 181/157 |
| 6,996,243 | B2 * | 2/2006 | Welker | H04R 1/02 381/160 |
| 2002/0118858 | A1 | 8/2002 | White et al. | |
| 2007/0081680 | A1 | 4/2007 | Yen | |
| 2008/0144864 | A1 | 6/2008 | Huon | |
| 2009/0003632 | A1 * | 1/2009 | Lin et al. | 381/182 |
| 2011/0135121 | A1 | 6/2011 | Harwood et al. | |
| 2012/0076328 | A1 | 3/2012 | Harwood | |

FOREIGN PATENT DOCUMENTS

| | | |
|---|---|---|
| EP | 1 292 170 A2 | 3/2003 |
| JP | 11225388 | 8/1999 |
| JP | 2004146953 | 5/2004 |
| WO | 96/29842 | 9/1996 |
| WO | 2007/069614 | 6/2007 |
| WO | WO 2011/053248 A1 | 5/2011 |

OTHER PUBLICATIONS

Peter Ferlow, "Isobarik Boxes" 2001-2003 http://members.shaw.ca/pferlow/isobarik_boxes.htm.

Peter Ferlow, "Back to Back" 2001-2003 http://members.shaw.ca/pferlow/back_to_back.htm.

Gdynia Magazyn Hi-Fi, "Isobaric Enclosure (Compound Enclosure)" 1991-2010 http://www.eng.hifi.pl/dictionary/isobaric.php.

Dahl, Axel, "Elipson CHAMBORD on thevintageknob.org," Mar. 31, 2010, pp. 1-3, XP055167041, [retrieved online Feb. 3, 2015], <http//www.thevintageknob.org/elipsonCHAMBORD.html>.

European Search Report from corresponding European Application No. 12814704.8, mailed on Feb. 12, 2015.

Chinese Office Action for corresponding Chinese Patent Application No. 2012800351191 dated Dec. 22, 2015.

International Search Report for corresponding International Application No. PCT/SE2012/050825 mailed PCT/SE2012/050825.

Form PCT/ISA/237 for corresponding International Application No. PCT/SE2012/050825 dated PCT/SE2012/050825.

* cited by examiner

ACOUSTICAL SIGNAL GENERATOR USING TWO TRANSDUCERS AND A REFLECTOR WITH A NON-FLAT CONTOUR

TECHNICAL FIELD OF THE INVENTION

The present invention relates to an audio generator. The present invention also relates to a method for producing an audio generator.

BACKGROUND DESCRIPTION OF RELATED ART

A common state of the art loudspeaker has a cone supporting a coil that can act as an electromagnet, and a permanent magnet. The cone, which may be made by paper, is typically movable in relation to the permanent magnet. When an electric signal is delivered to the coil, the coil acts as an electromagnet to generate a magnetic field acting on the permanent magnet so as to cause the cone to move in relation to the permanent magnet. In some sound reproduction systems, multiple loudspeakers may be used, each reproducing a part of the audible frequency range. Miniature loudspeakers are found in devices such as radio and TV receivers, and many forms of music players. Larger loudspeaker systems are used for music reproduction e.g. in private homes, in cinemas and at concert arenas.

SUMMARY

It is an object of the present invention to address the problem of achieving an improved audio generator for reproduction of sound waves.

According to an aspect of the invention, this problem is addressed by an audio generator (410, 190) comprising:

a first transducer element (210A) being mounted such that the first transducer element (210A) can cause audio waves to propagate in a first direction (M);

a second transducer element (210B) being mounted such that the second transducer element (210B) may cause audio waves to propagate in a second direction which is different to the first direction (M);

an enclosure (310) adapted to enclose a space (320) between the first transducer element (210A) and the second transducer element (210B); wherein the first transducer element (210A) has a first membrane (240A) having a surface (242A) which is non-flat, and wherein the first membrane (240A) has an outer perimeter (270) which is flexibly attached to a portion (282) of a transducer element body (280); said outer perimeter (270) defining a first aperture (315) having a first aperture plane (314); and wherein, in operation, the first membrane (240A) is adapted to cause said audio pressure waves to propagate in the first direction (M, 300, 300A,) orthogonal to said first aperture plane (314); wherein said audio generator (410, 190) further comprises a reflector (400), the reflector (400) having a surface (442) adapted to reflect acoustic signals; and directive guiding walls (510,520,530,540)

the reflector (400) co-operating with the directive guiding walls so as to lead and guide said audio pressure waves to propagate in a second direction (300'); said second direction (300') being different from said first direction; and wherein the acoustically reflective surface (442) has a non-flat contour (242').

Since the two membranes will move in the same direction at the same time they will effectively interact in a co-operative manner so as to defeat any mechanical resistance to membrane movement. Advantageously, air trapped in between the membranes will move with the movement of the membranes. Moreover, this solution eliminates or significantly reduces any air pressure variations in the space within the enclosure. Air being a compressible medium, such air pressure variations in the space 320 within the enclosure 310 may otherwise lead to a spring-like force acting on the membrane, which could lead to slower response and hence to distortion. Hence, whereas state of the art transducers for transforming an electric speaker drive signal into an acoustic signal inherently cause a distortion such that the acoustic signal generated by a state of the art transducer fails to truly represent the electric speaker drive signal, this solution advantageously enables the first transducer element membrane to provide an improved degree of fidelity in the sense of correctly representing the electric speaker drive signal. Accordingly, when the electric speaker drive signal is such as to provide a high degree of fidelity in the sense of correctly representing an original acoustic signal this solution advantageously enables the first transducer element membrane to provide an improved degree of fidelity in the sense of correctly representing the original acoustic signal.

The non-flat contour of the reflector may cooperate with the non-flat membrane so as to cause reflection of the sound such that two acoustic waves W1' and W2', being created at mutually different positions on the membrane will have traveled substantially the same distance when they reach the plane of the second aperture. Hence, the sound waves delivered from the second aperture of the audio generator may advantageously be truly plane sound waves.

Accordingly, the provision of two cooperating transducer elements advantageously interact with the provision of a reflector having non-flat contour so as to enable the audio generator to provide an improved degree of fidelity in the sense of correctly representing the original acoustic signal, when the electric speaker drive signal is such as to provide a high degree of fidelity in the sense of correctly representing an original acoustic signal. According to an embodiment, the enclosure is a sealed enclosure.

Additional aspects of the invention are discussed below in this document, and various embodiments, as well as advantages associated thereto are disclosed.

BRIEF DESCRIPTION OF THE DRAWINGS

For simple understanding of the present invention, it will be described by means of examples and with reference to the accompanying drawings, of which

DETAILED DESCRIPTION OF EMBODIMENTS

Figure 1:
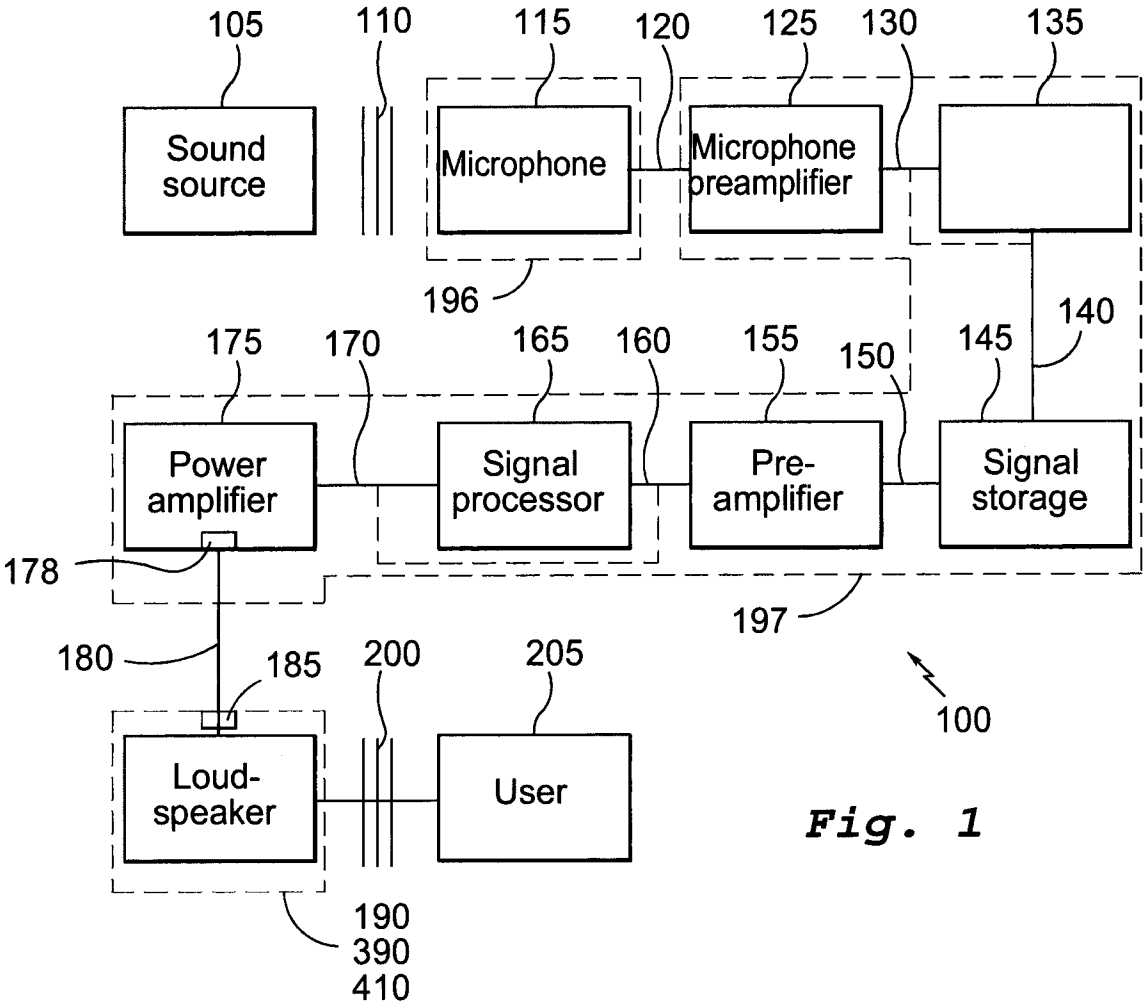
FIG. 1 shows a schematic block diagram of a first embodiment of a system 100 according to the present invention.

FIG. 1 shows a schematic, exemplifying system 100 according to the present invention. The system 100 is adapted to reproduce sound waves. The system comprises a sound source 105 adapted to emit an original acoustic signal 110. The original acoustic signal is formed by sound waves. One example of a sound source 105 is a vocalist. The vocalist emits an original acoustic signal 110 while singing a song. Another example of the sound source 105 emitting an original acoustic signal 110 is a speaker giving a speech. Yet another example of a sound source 105 emitting an original acoustic signal 110 is an orchestra performing a piece of music. This description will discuss sound sources 105 emitting an original acoustic signal 110 audible to human beings and the reproduction of such sounds, but the present invention could also be applied to systems 100 comprising sound sources 105 emitting other acoustic signals, such as e.g. acoustic signals formed by subsonic sound waves or ultrasonic sound waves.

The system 100 further comprises a transducer 115, such as e.g. a microphone 115, adapted to transform the original acoustic signal 110 into a microphone signal. The microphone is adapted to receive the original acoustic signal 110 by letting the sound waves exert a force on the microphone's 115 moving element. The microphone 115 is further adapted to create the microphone signal 120 formed by an electrical voltage signal based on the vibrations of the microphones moving element. The level or amplitude of the microphone signal 120 is normally very low, typically in the microvolt range, for example 0-100 μV. The microphone 115 may be a capacitor microphone having a flat plate which may be set in motion in response to air pressure deviations caused by acoustic waves.

The system 100 may further comprise a microphone preamplifier 125 adapted to output a microphone line level signal 130 with a greater level than the microphone signal 120. The level of the microphone line level signal 130 is typically in the volt range, for example 0-10 V.

The system 100 may optionally comprise a signal treater 135. The signal treater 135 may include an analogue-to-digital converter, ADC, adapted to generate a first digital signal 140 in response to the microphone signal 120 so that the first digital signal 140 is a digital representation of the microphone signal 120. The signal treater 135 may also include digital processing of the microphone line level signal 130. The signal treater 135 is further adapted to output the first digital signal 140.

The system 100 may also comprise a signal storage device 145 adapted to store either the analogue microphone line level signal 130, or if a signal treater 135 is present in the system 100, the first digital signal 140. The first digital signal 140 may be stored on a data carrier 142, such as a non-volatile memory. The non-volatile memory may be embodied as a magnetic tape, hard-drive, or compact disc. The signal storage device 145 may also have an output for delivery of a signal 150 retrieved from the data carrier 142. Alternatively the stored signal may be retrieved by a separate device for retrieval of a stored signal from the data carrier 142. Such a separate device may be embodied e.g. by a tape player or compact disc player.

The system further comprises a preamplifier 155 adapted to prepare either the microphone line level signal 130, or if a signal treater 135 is present the processed microphone signal 140, or if a signal storage 145 is present the stored signal 150 for further processing or amplification. The preamplifier is further adapted to adjust the level of the input signal (130, 140 or 150). The preamplifier 155 is further adapted to output a line signal 160 based on the input signal (130, 140 or 150).

The system may optionally comprise a signal handler 165 adapted to process the line signal 160. The signal handler may include an optional D/A-converter, when the system 100 is adapted for digital sound. The signal handler may also optionally include a signal processor, which may be implemented in a mixer board. The signal handler 165 has an output for delivery of a second line level signal 170.

The system further comprises a amplifier 175 adapted to generate an electric speaker drive signal 180 for delivery on an amplifier output 178. According to an embodiment of the invention the amplifier 175 is a power amplifier 175. The speaker driver signal 180 may be generated in response to the line level signal 160, or if a signal processor 165 is present in the system 100, in response to the processed second line level signal 170. In this manner, the power amplifier may generate an analogue electric signal 180 such that a time portion of the analogue electric signal 180 has the same, or substantially the same, wave form as the corresponding time portion of the microphone signal 120. According to an embodiment the electric speaker drive signal 180 may be delivered to an input 185 of an electro-audio transducer 190. The electro-audio transducer 190 operates to generate an acoustic signal 200 in response to the electric speaker drive signal 180 received on the input 185. The acoustic signal 200, which may include e.g. music, may be heard by a user 205.

As mentioned above, an audio/electric transducer 115, such as a microphone, may operate to transform an acoustic signal 110 (See FIG. 1) into an electric microphone signal 120. There exist state of the art transducers which are capable of transforming an acoustic signal 110 into an electric microphone signal 120 such that the electric microphone signal 120 has a high fidelity in the sense of correctly representing the acoustic signal 110. However, state of the art transducers for transforming an electric speaker drive signal 180 into an acoustic signal inherently cause a distortion such that the acoustic signal generated by a state of the art transducer fails to truly represent the electric speaker drive signal 180. In effect, state of the art sound reproduction systems inherently fail to generate an acoustic signal which truly represents the original acoustic signal 110. Hence, even when the electric speaker drive signal 180 is such as to provide a high degree of fidelity in the sense of correctly representing the acoustic signal 110, state of the art loud speakers inherently introduce distortion such that sound generated by the state of the art loud speaker has a lower degree of fidelity in the sense of correctly representing the acoustic signal 110 than the electric speaker drive signal 180.

Figure 2A:
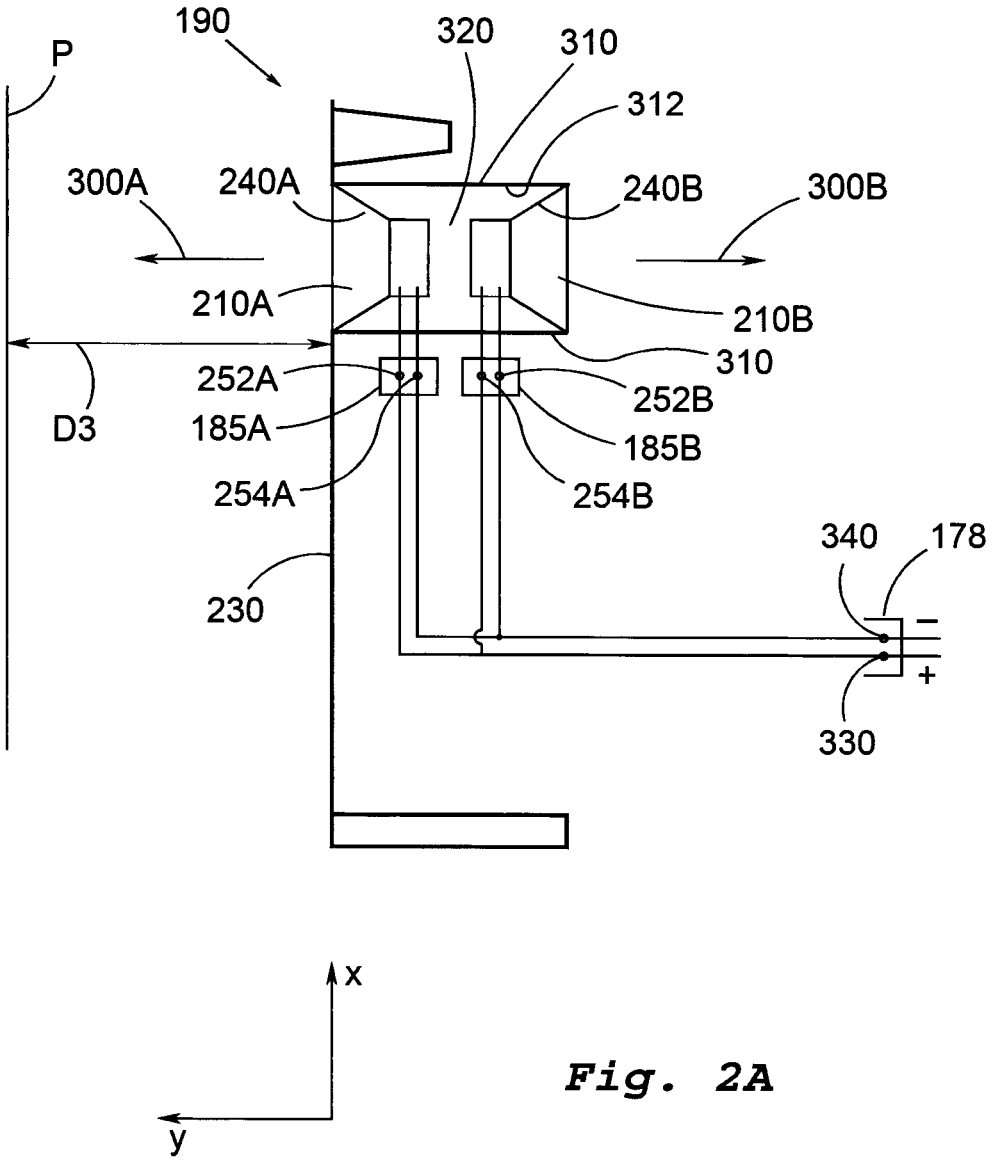
FIG. 2A is a schematic side view of an embodiment of an electro-audio transducer.

FIG. 2A is a schematic side view of an embodiment of an electro-audio transducer 190. The electro-audio transducer 190 includes a first transducer element 210A and a second transducer element 210B, and a baffle 230.

Figure 3:
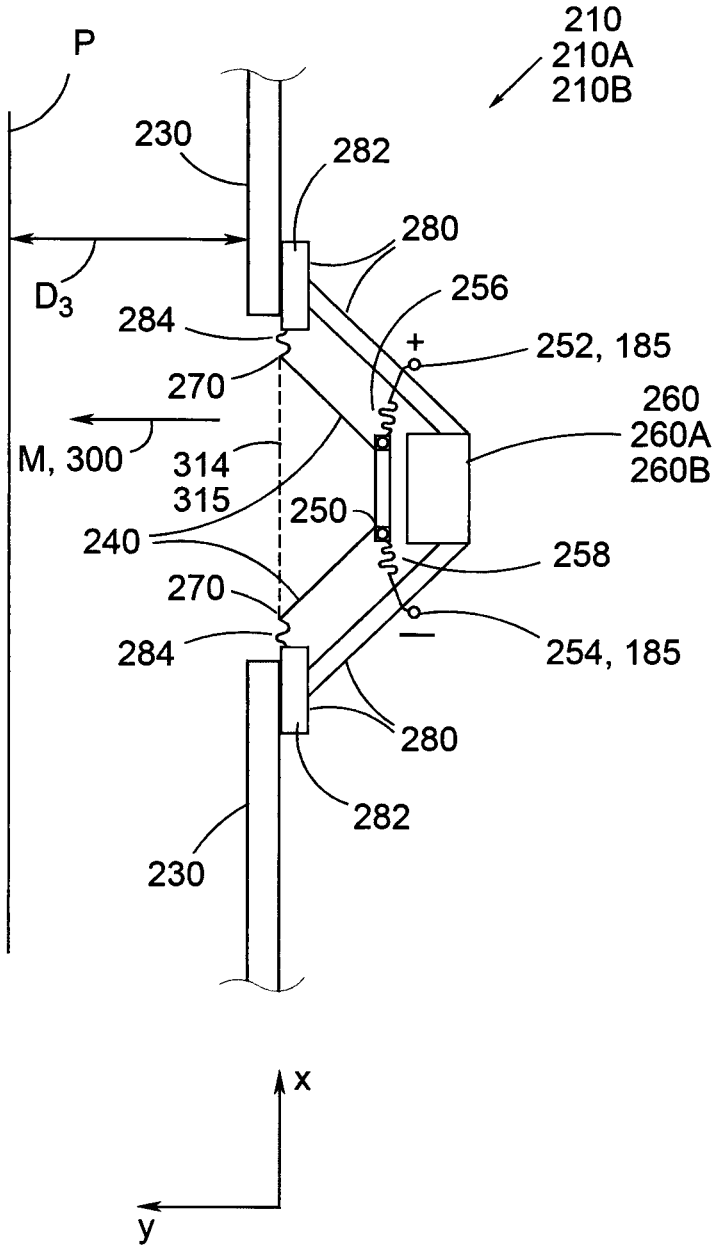
FIG. 3 is a schematic side view of an embodiment of a transducer element.

FIG. 3 is a schematic side view of an embodiment of a transducer element 210 which may be used in the electro-audio transducers discussed in this document. The transducer element 210 has a membrane 240 including means 250 for causing the membrane 240 to move in dependence on an electric input signal. The membrane movement generator 250 may include a coil 250 adapted to generate a magnetic field in response to reception of a drive signal, such as drive signal 180, which may be delivered via drive terminals 252 and 254. The transducer element 210 may also include a permanent magnet 260 which is firmly attached to a transducer element body 280. The membrane 240 has an outer perimeter 270 which may be flexibly attached to a portion 282 of the transducer element body 280. The flexibility may be attained by a flexible member 284 being adapted to physically connect the outer perimeter 270 of the membrane 240 with the portion 282 of the transducer element body 280. The drive terminals 252 and 254 may be electrically connected to the coil 250 by electrical conductors 256 and 258, respectively, being adapted to allow the desired movement of the membrane 240 while allowing the terminals 252 and 254, respectively, to remain immobile in relation to the transducer element body 280. The transducer element body 280 may be attachable to the baffle 230.

The membrane 240 is movable in relation to the transducer element body 280 in response to the drive signal 180. When the electric signal 180 is delivered to the coil, the coil acts as an electromagnet to generate a magnetic field which, when interacting with the magnetic field of the permanent magnet 260, generates force such that the membrane 240 moves in relation to the permanent magnet 260. The transducer element 210 is adapted to cause the membrane 240 to move only, or substantially only, in the direction of arrow 300 in FIG. 2, while holding membrane 240 immobile, or substantially immobile, in all directions perpendicular to the direction of arrow 300. In this manner the membrane 240 may cause audio waves to propagate in the direction of arrow 300 (See FIG. 3), away from membrane 240, when a variable electric signal 180 is delivered to the coil 250.

The direction of arrow 300, in FIG. 3, may be orthogonal to the plane 314 of a first aperture 315. The first aperture 315 may be defined by the outer perimeter 270 of the membrane 240. When the membrane 240 is cone shaped, the first aperture plane 314 may be defined by the base of the membrane cone 240.

Hence, the transducer element 210 may be adapted to cause the membrane 240 to move only, or substantially only, in a direction 300 orthogonal to the plane 314 of a first aperture 315, while holding the membrane 240 immobile, or substantially immobile, in all directions parallel to the plane 314 of a first aperture 315.

According to an embodiment the membrane 240 is made of a light weight material having a certain degree of stiffness. According to an embodiment membrane 240 is cone-shaped, as illustrated in FIG. 3. The material, of which the cone-shaped light weight membrane 240 is made, may include paper.

Referring to FIG. 2A, the electro-audio transducer 190 includes the first transducer element 210A being mounted to the baffle 230 such that the first transducer element 210A may cause audio waves to propagate in the direction of arrow 300A. Additionally the electro-audio transducer 190 includes a second transducer element 210B being mounted such that the second transducer element 210B may cause audio waves to propagate in the direction of arrow 300B, that is in the direction opposite to the direction of arrow 300A.

The electro-audio transducer 190 includes an enclosure 310 adapted to enclose a space 320 between the first transducer element 210A and the second transducer element 210B. According to an embodiment the enclosure 310 is a sealed enclosure. Hence, the enclosure 310 has a body 312 so that the body 312 cooperates with the membranes 240A and 240B so as to prevent air from flowing freely between the air volume within the enclosure 310 and the ambient air.

The two transducer elements 210A and 210B may advantageously be connected in reverse phase, as illustrated in FIG. 2A. Accordingly, a positive terminal 330 of amplifier output 178 may be connected to the positive terminal 252A of transducer elements 210A and to the negative terminal 254B of transducer element 210B; and a negative terminal 340 of amplifier output 178 may be connected to the negative terminal 254A of transducer element 210A and to the positive terminal 252B of transducer element 210B. This reverse phase connection has the effect that when membrane 240 A moves in the direction of arrow 300A, then also membrane 240B moves in the direction of arrow 300A. When the enclosure 310 is a sealed enclosure 310, and the two transducer elements 210A and 210B are connected in reverse phase, then the air trapped in between the membranes will move with the movement of the membranes 240A and 240B. Since the two membranes will move in the same direction at the same time they will effectively interact in a co-operative manner so as to defeat any mechanical resistance to membrane movement. Moreover, this solution eliminates or significantly reduces any air pressure variations in the space 320 within the enclosure 310. Air being a compressible medium, such air pressure variations in the space 320 within the enclosure 310 may otherwise lead to a spring-like force acting on the membrane, which could lead to slower response and hence to distortion.

When the transducer element 210 is designed so that the coil can move between positions with mutually different magnetic field amplitude, the force, generated by a certain electric current amplitude in the coil, may be weaker when the coil is in a position where it experiences weaker magnetic field amplitude, as compared to the force, generated by that certain electric current amplitude in the coil when the coil is in a position where it experiences stronger magnetic field amplitude.

Advantageously, when the two transducer elements 210A and 210B are connected in reverse phase, as illustrated in FIG. 2, the coils 250A and 250B will be in mutually different positions, i.e. if coil 250A experiences weaker magnetic field amplitude then coil 250B will be in a position to experience a stronger magnetic field amplitude. Accordingly, the electro-audio transducer 190 including first transducer element 210A and second transducer element 210B such that when membrane 240A moves in the direction of arrow 300A, then also membrane 240B moves in the direction of arrow 300A, advantageously renders an electro-magneto-mechanical interaction between the transducer elements 210A and 210B. According to an embodiment, referring to FIG. 3 in conjunction with FIG. 2 for example, when the coil 250A is far away from the magnet 260A so as to experience a relatively weak magnetic field amplitude then coil 250B will be close to the magnet 260B so as to experience a stronger magnetic field amplitude.

Figure 2B:
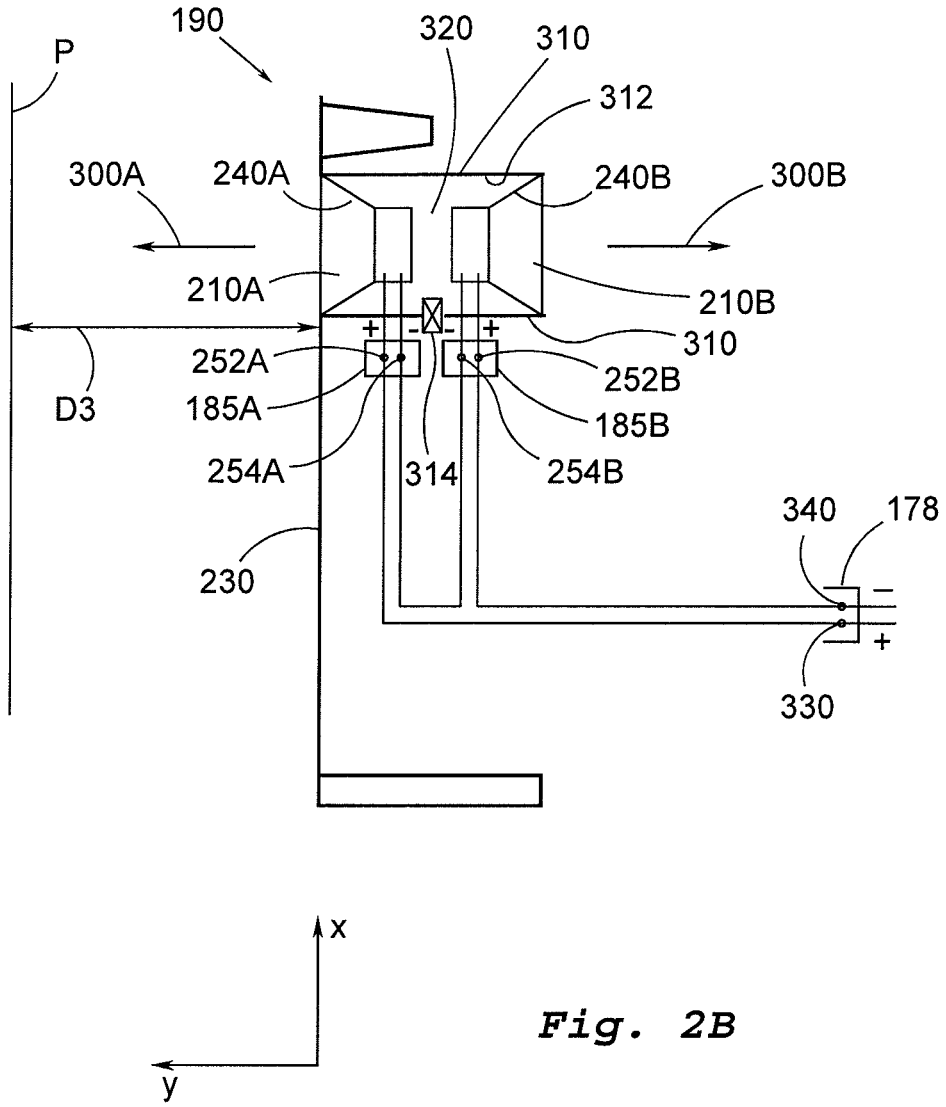
FIG. 2B is a schematic side view of another embodiment of an electro-audio transducer.

FIG. 2B is a schematic side view of another embodiment of an electro-audio transducer 190. The FIG. 2B embodiment may be substantially as described in connection with FIG. 2A, but with the following modifications: According to the FIG. 2B embodiment, the enclosure 310 may be a sealed enclosure, wherein a body 312 of the enclosure 310 includes means 318 for air pressure equalization. According to an embodiment, the means 318 for air pressure equalization may include a valve 318, the valve being openable so as to allow an equalization of air pressure between the air volume within the enclosure 310 and the ambient air, and closeable so as the make the enclosure 310 is a sealed enclosure.

In this context it is noted that the ambient air pressure may vary due to weather conditions, causing e.g. so called low pressures or high pressures. Also, when the electro-audio transducer 190 has been transported between different geographical places or altitudes, such as e.g. from a place near sea level to another place a couple of hundred meters above sea level, the ambient air pressure will have changed.

The means 318 for air pressure equalization advantageously allows for an equalization of the air pressures to be performed, e.g., prior to use of the electro-audio transducer 190 for production of acoustic signals 200 (See FIG. 1 in conjunction with FIG. 2B). Accordingly, the provision of a means 318 for air pressure equalization advantageously allows for optimum operation of the electro-audio transducer 190, irrespective of weather and geographical position.

According to another embodiment, the means 318 for air pressure equalization may include a throttling means 318, adapted to allow a very slow equalization of air pressure between the air volume within the enclosure 310 and the ambient air. In this context it is noted that the throttling means 318 may include a minute passage adapted to allow for a very slow equalization of air pressure As mentioned in connection with FIG. 2A, the two transducer elements 210A and 210B may advantageously be connected in reverse phase. Whereas FIG. 2A illustrates an embodiment wherein the two transducer elements (210A, 210B) are connected in parallel, FIG. 2B illustrates an embodiment wherein the two transducer elements (210A, 210B) are connected in series.

The sound waves exciting via the aperture 315A of transducer element 210A may propagate into the surrounding space primarily in the direction 300A. However, the nature of sound waves is such that they may spread somewhat also in other directions than the desired direction 300A, in a constellation as illustrated in FIG. 2A or 2B. According to an embodiment of the invention, however, the audio generator 410 may also include directive guiding walls so as to cause an increased sound propagation focus in the direction 300A.

Figure 2C:
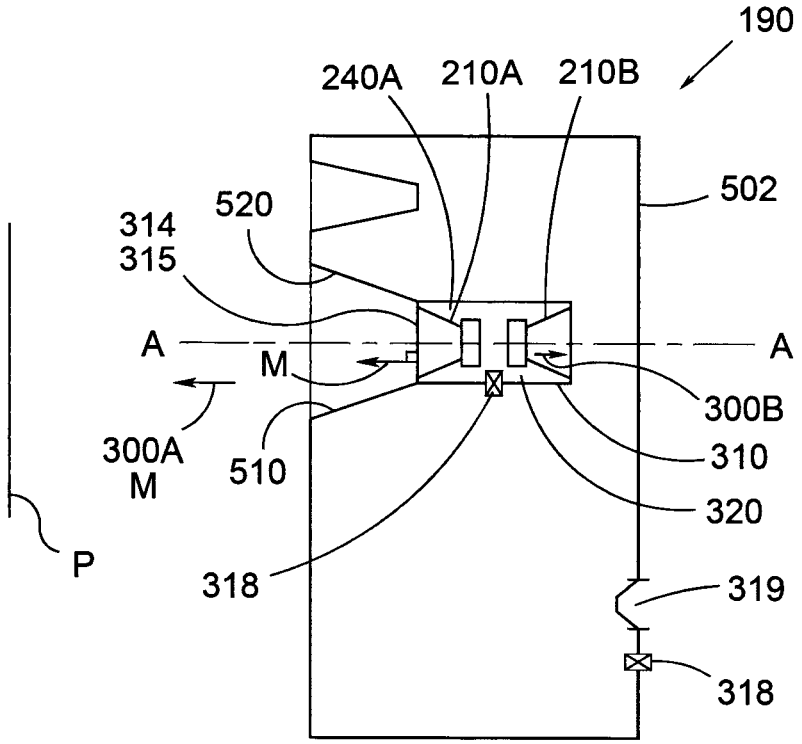
FIG. 2C is a schematic side view of another embodiment of an electro-audio transducer.

FIG. 2C is a schematic side view of another embodiment of an electro-audio transducer 190. The FIG. 2*c* embodiment may be substantially as described in connection with FIGS. 2A and/or 2B, but with the following modifications:

The electro-audio transducer 190 according to the FIG. 2C embodiment may include a box structure 502. The box structure 502 holds the enclosure 310, which may be as described above. Moreover, box structure 502 includes directive guiding walls 510, 520, 530 and 550 adapted to lead and guide said audio pressure waves so as to focus the direction of propagation of the audio pressure waves caused by the transducer element 210A in the direction M, 300A.

The box structure 502 may also be provided with a means 318 for air pressure equalization, as described above, and it may have an opening 319 or so called slave base element 319.

Figure 2D:
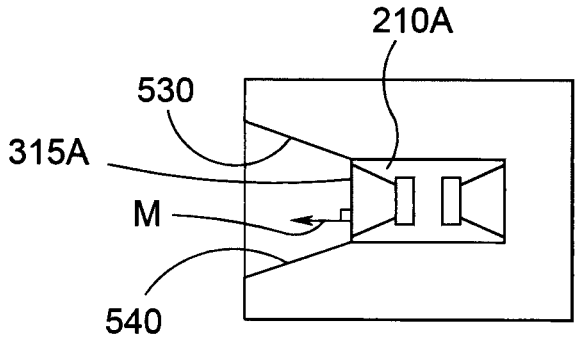
FIG. 2D is a schematic cross-sectional view taken along line A-A of FIG. 2C.

FIG. 2D is a schematic cross-sectional view taken along line A-A of FIG. 2C. Hence, when movement of the membrane 240A causes a momentary increase in air pressure, i.e. a pressure pulse, having a direction of propagation v in the direction M, orthogonal to the plane of the first aperture plane 315, the pressure pulse is maintained and directed by the directive guiding walls 510, 520, 530 and 550 so as to focus the direction of movement of the pressure pulse in the direction 300A' towards a plane P at a distance from the audio generator 410.

Since a listener 205 will typically enjoy music at a distance D3 of more than one meter, or so, from the audio generator 410, it is advantageous to have the sound (which is composed of successive controlled pressure pulses) directed.

When a plane wave front of narrow width leaves a source, it will inherently spread sideways in a manner that causes the resulting wave front to be curved at a large distance from the source. In this connection, the directive guiding walls operate to lead and guide the successive pressure pulses as they propagate from the first aperture.

A Phase Adjusting Reflector

Figure 4:
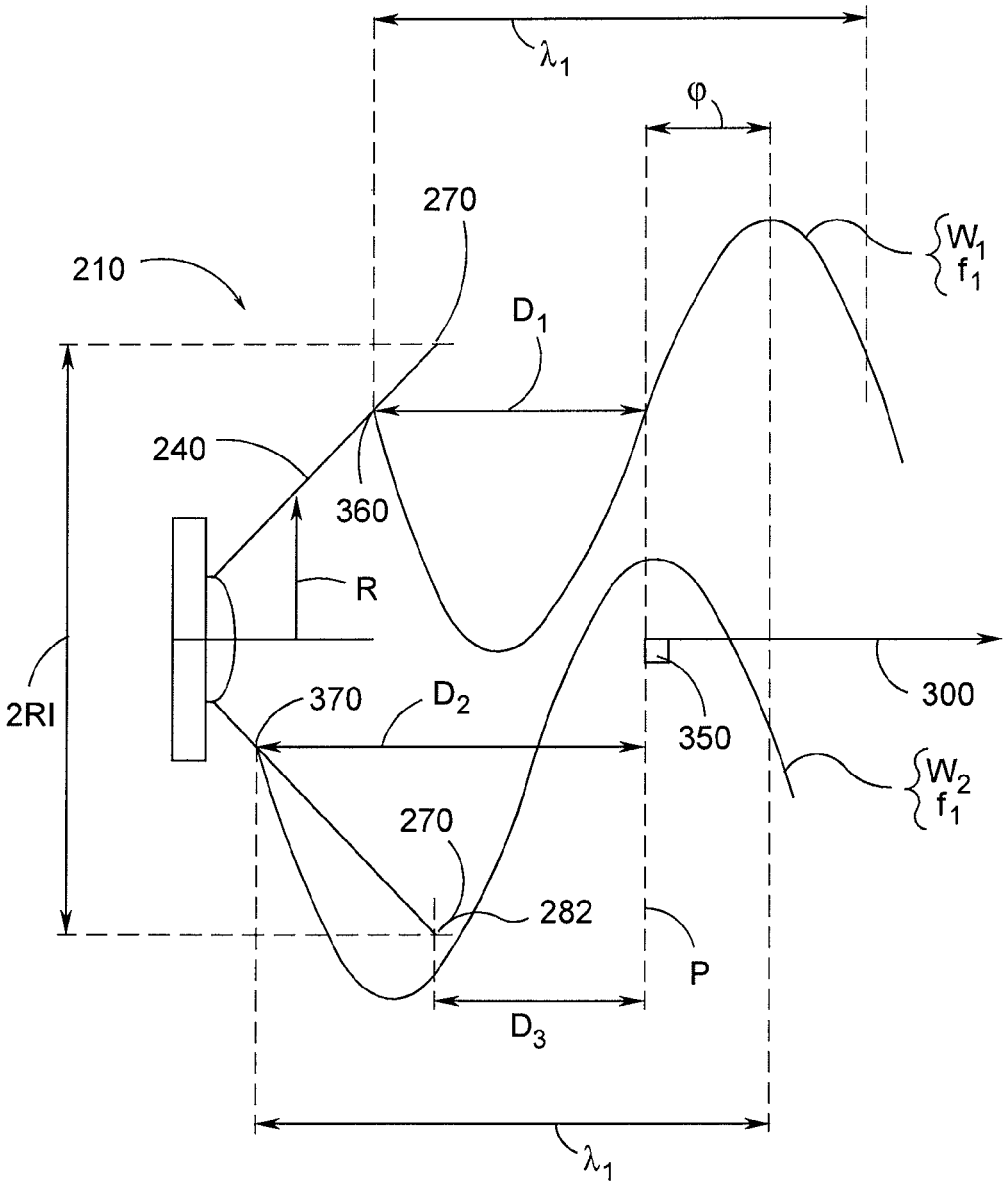
FIG. 4 is a schematic side view of an embodiment of a transducer element.

FIG. 4 is a schematic side view of an embodiment of a transducer element 210. The transducer element 210 illustrated in FIG. 4 may be designed e.g. as described with reference to FIG. 3 above. This transducer element 210 may be used in the electro-audio transducer 190 of FIG. 2. As mentioned above, the transducer element 210 is adapted to cause the membrane 240 to move only, or substantially only, in the direction of arrow 300 (See FIG. 4 and FIG. 3) so as to cause audio waves to propagate in the direction of arrow 300, away from membrane 240, when a variable electric signal 180 is delivered to the membrane movement generator 250. The membrane movement generator 250 may include a coil 250, as mentioned above.

Hence, the direction of sound propagation is in the direction of arrow 300, which is the normal vector to the plane P in FIG. 4, i.e. the direction of sound propagation is primarily in the direction of membrane movement. Accordingly, when: the spatial shape of the membrane is not parallel to the plane P, then: two acoustic waves W1 and W2, respectively, may be created at mutually different distances D1 and D2, respectively, from the plane P. The inventor realized that the two acoustic waves W1 and W2, being created at mutually different positions 360 and 370, respectively, will lead to distortion of the sound, as experienced by a user having an ear at a position along the plane P (See FIG. 4). In fact, the inventor realized that when the spatial shape of the audio generating membrane 240 is not parallel to a plane P at a distance $D_3$ from the from the front portion 282 of a transducer element 210, some frequencies may be suppressed and other frequencies may be accentuated, as experienced at any distance D3 from the front portion 282 of a transducer element 210 (See FIG. 4 and/or FIG. 2).

According to the FIG. 4 embodiment, the membrane 240 is, at least in part, cone-shaped. Hence, the spatial shape of the membrane is not parallel to a plane P (See FIG. 4) which is orthogonal to the direction of sound propagation. With reference to FIG. 4, the arrow 300 may be normal to the plane P, as illustrated by the angle at reference 350 in FIG. 4, being a 90 degree angle. Hence, two acoustic waves W1 and W2, respectively, of the same frequency f1 being created at mutually different positions 360 and 370, respectively, will be offset in phase in relation to each other. This phase offset, or phase deviation, is indicated as $\phi$. The inventor realized that, for each particular constituent frequency in the generated audio signal 200 (See FIG. 1) the phase deviation $\phi$ depends on the distance deviation dD=D2−D1 (See FIG. 4 in conjunction with FIG. 1). This is due to the fact that a signal having a certain frequency f1 will exhibit a corresponding wave length $\lambda 1$ as it travels through air (See FIG. 4). For example, a 10 kHz acoustic signal travelling through air exhibits a wave length of about 34 mm, whereas a 100 Hz signal travelling through air exhibits a wave length of about 3400 mm, i.e. about 3.4 meters.

When the membrane 240 is in the shape of a truncated cone, as illustrated in FIG. 4, the maximum distance deviation dD=D2−D1 varies in dependence on the radius R of the cone-shaped membrane 240.

Accordingly, the inventor devised a solution addressing the problem of achieving an improved electro-audio transducer.

With reference to FIG. 1, the inventor devised a solution addressing the problem of achieving an improved electro-audio transducer having a higher degree of fidelity in the sense of correctly representing the original acoustic signal 110 when the electric speaker drive signal 180 is such as to provide a high degree of fidelity in the sense of correctly representing the original acoustic signal 110.

In particular, the inventor devised a solution addressing the problem of achieving an improved electro-audio transducer which eliminates, or substantially reduces distortion of the sound, as experienced by a user having an ear at a position along a plane P at a distance D3 from the electro-audio transducer 190 (See FIG. 1, 3 or 4).

An original acoustic signal 110 may include plural signal frequencies, each of which is manifested by a separate wave length as the acoustic signal 110 travels through air. In order to regenerate an acoustic signal 200 which truly represents the original acoustic signal 110 (See FIG. 1) the following conditions apply:

A) The mutual temporal order of appearance, between any two signals in the original acoustic signal 110 must be maintained in the reproduced acoustic signal 200.

B) The mutual amplitude relation, between any two signals in the original acoustic signal 110 must be maintained in the reproduced acoustic signal 200.

Figure 6:
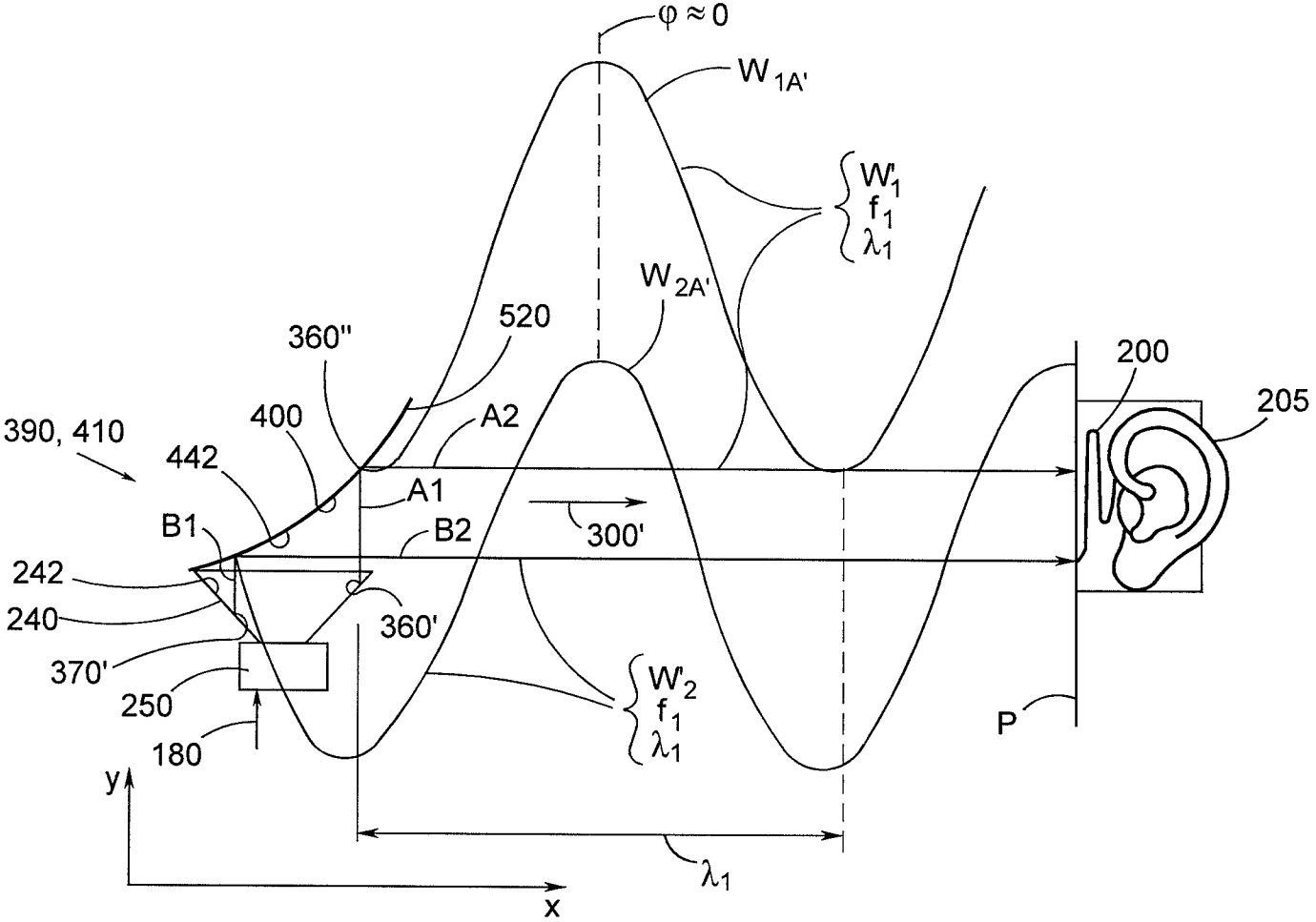

The above condition A) may be scrutinized for at least two cases:

A1) The mutual temporal order of appearance, between any two signals having the same signal frequency in the original acoustic signal 110, must be maintained in the reproduced acoustic signal 200 (compare FIGS. 4 and 6). If condition A1 is not fulfilled, the effect is two-fold:

Firstly, the duration of that particular reproduced acoustic signal frequency $f1_{200}$ will be extended as compared to the original acoustic signal $f1_{110}$. The temporal extension $T_{EXT}$ will be approximately $$T_{EXT}=dD/v$$

wherein dD=D2−D1, and v=the speed of the acoustic signal

For sound reproduction, the speed v of the acoustic signal in air at room temperature and at normal air humidity is about 340 meters per second. This temporal extension $T_{EXT}$ is caused since a single electrical drive signal 180 having a frequency f1 with a distinct start time $t_{START}$, and a distinct end time $t_{END}$, will cause the state of the art loud speaker to produce plural acoustic signals (See FIG. 4). It can be deduced, e.g. from the illustration of FIG. 4, that a front edge of a wave W1, will reach the plane P earlier than the front edge of another wave W2, since the wave W1 started from a position closer to the plane P. This may be experienced, by a listener at plane P, as a smearing of the acoustic signal.

Secondly, the phase deviation $\phi$, as illustrated in FIG. 4, may cause the wave W1 to interact with the wave W2 at the plane P under the principle of superposition. In very brief summary, the superposition principle, also known as superposition property, states that, for all linear systems, the net response at a given place and time caused by two or more stimuli is the sum of the responses which would have been caused by each stimulus individually. Acoustic waves are a species of such stimuli. Waves are usually described by variations in some parameter through space and time—for example, height in a water wave, or the pressure in a sound wave. The value of this parameter is referred to as the amplitude of the wave, and the wave itself is a function specifying the amplitude at each point in a space filled with air, such as e.g. a room. An arbitrary point in the plane P (See FIG. 4) is an example of such a point in space.

When the superposition principle is applied to the pressure in a sound wave, the waveform at a given time is a function of the sources and initial conditions of the system. An equation describing a sound wave may be regarded as a linear equation, and hence, the superposition principle can be applied. That means that the net amplitude caused by two or more waves traversing the same space, is the sum of the amplitudes which would have been produced by the individual waves separately. Hence, the superposition of waves causes interference between the waves. In some cases, the resulting sum variation has smaller amplitude than the component variations. In other cases, the summed variation will have higher amplitude than any of the components individually. Hence, a breach of the above condition A1 may result also in a breach of the above condition B.

A2) The mutual temporal order of appearance, between any two signals having the different signal frequency in the original acoustic signal 110, must be maintained in the reproduced acoustic signal 200. When an original acoustic signal 110 includes two separate signal component frequencies f1 and f2, e.g. one treble signal component including a frequency f1 of 10 000 Hz and another signal component including a frequency f2 of 50 Hz, a system for reproduction of acoustic signals may attempt to reproduce this multi-component acoustic signal 110, using separate transducer elements, such as a tweeter transducer element for reproducing the high frequency component f1 and a base transducer element for reproducing the low frequency component f2. In this connection, please see discussion below in connection with FIG. 9.

When the membrane 240 is in the shape of a truncated cone, as illustrated in FIG. 4, the maximum distance deviation dD=D2−D1 depends on the radius R of the cone-shaped membrane 240, as mentioned above. When the membrane 240 is cone-shaped, the outer perimeter 270 of the membrane 240 is circular with a radius R1 defining the base of the membrane cone.

Figure 5:
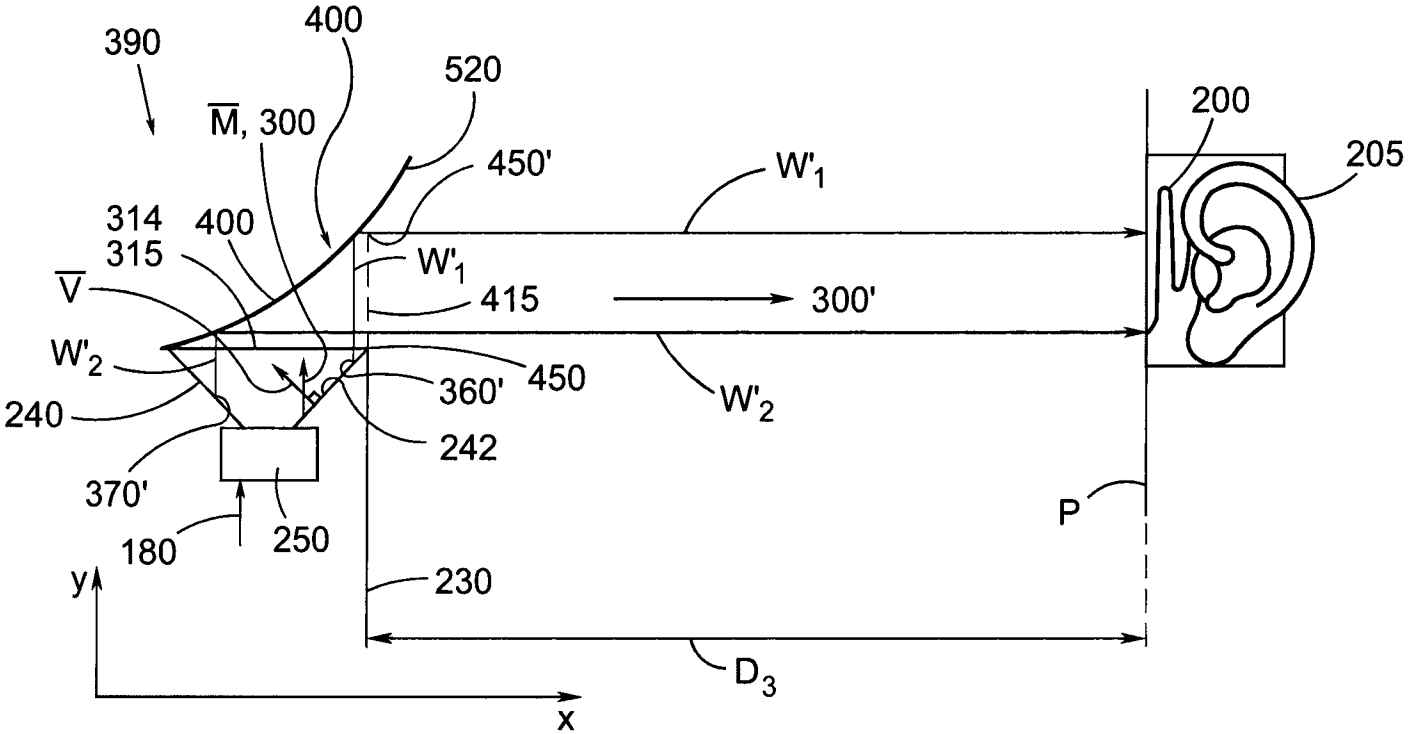
FIGS. 5 and 6 are schematic side views of embodiments of an audio generator.

With reference to FIG. 5, there is provided an audio generator 390 having a membrane 240 including a membrane movement generator 250 for causing the membrane 240 to move in dependence on an input signal. The surface 242 of the membrane 240 is such that there exists a vector V which is normal to the membrane surface while said vector V is unparallel to the primary direction M of movement of the membrane 240. Hence, the primary direction M of movement of the membrane 240 coincides with the direction 300 of propagation of audio waves away from membrane 240, when a variable electric signal 180 is delivered to the membrane movement generator 250. This is fundamental, of course, since the audio waves are created by the movement of the membrane 240.

The audio generator 390 includes a reflector 400 adapted to cause reflection of the sound such that two acoustic waves W1' and W2', being created at mutually different positions 360' and 370', respectively, on the membrane 240 will have traveled substantially the same distance when they reach a plane P at a distance D3 from audio generator 390. According to an embodiment, the distance D3 is much larger than the largest distance from the surface of the membrane to the surface of the reflector.

The audio generator 390 may also include a baffle, schematically illustrated with reference 230 in FIG. 5.

In this manner the audio generator 390, 410 may cause audio waves to propagate in the direction of arrow 300' towards the plane P (See FIGS. 5 and/or 6), when a variable electric drive signal 180 is delivered to the membrane movement generator 250. The outer perimeter 270 of the membrane 240 defines the first aperture 315 through which the acoustic signal will flow, when the transducer element 210 is in operation. In effect, a ray of the acoustic signal generated at point 360' of the membrane 240 may travel in the direction of arrow M (See FIG. 5), i.e. in a direction orthogonal to the plane 314 of the first aperture 315.

When reflected in the direction towards plane P, the wave will pass a second aperture 415 of the audio generator 390, 410 (See FIG. 5). With reference to FIG. 5, the plane 416 of second aperture 415 is perpendicular to the plane of the paper and perpendicular to the direction of arrow 300'. The second aperture 415 stretches from a point 450 substantially at the perimeter 270 of membrane 240 to a point 450'. As illustrated by FIG. 5, the sound ray W1' as well as the sound ray W2' pass through the second aperture 415. The reflector 400 may be "tailor-made" to cooperate with membrane 240 so as to cause reflection of the sound such that two acoustic waves W1' and W2', being created at mutually different positions 360' and 370', respectively, on the membrane 240 will have traveled substantially the same distance when they reach the plane 416 of the second aperture 415. Hence, the sound waves delivered from the second aperture 415 of the audio generator 390, 410 (See FIG. 5) may advantageously be truly plane sound waves.

Moreover, directive guiding walls 510, 520, 530, 540, similar to, or of same design as described above in connection with FIGS. 2C and D may be provided. The directive guiding walls are schematically illustrated in FIG. 5 by the guiding wall 520 extending beyond the upper edge 450' of the second aperture 415.

FIG. 6 is a schematic side view of an embodiment of an audio generator 390, 410. The audio generator 390, 410 of FIG. 6 may be as described with reference to FIG. 5 above. The audio generator 390, 410 may include a transducer element 210, as described in connection with FIG. 3 above. The audio generator 410 may include a membrane 240 having a surface 242 which is non-flat, a baffle 230; and a reflector 400, wherein the reflector 400 has a surface shape adapted to reflect audio waves propagating from the membrane surface such that a phase deviation ϕ, between two audio waves, caused by said non-flat surface 242 is substantially eliminated at an arbitrary distance D3 from the audio generator 410. This advantageous effect, attained by the audio generator 390 of FIG. 5 and the audio generator 410 of FIG. 6, may be readily understood by looking at FIG. 6, and comparing with FIG. 4. Hence, the phase deviation ϕ, between two audio waves W1' and W2', respectively, caused by the non-flat surface 242, may be substantially eliminated at an arbitrary distance D3 from the audio generator 410. This is due to the fact that the two acoustic waves W1' and W2', being created at mutually different positions 360' and 370', respectively, on the membrane 240, will have traveled substantially the same distance when they reach a plane P at a distance D3 from audio generator 390 when the reflector 400 has a surface 442 adapted to reflect acoustic signals and the acoustically reflective surface 442 has a non-flat contour which has been defined in dependence on the contour of the non-flat surface 242 of the membrane 240.

As clearly shown in FIG. 6, when an audio wave W1' travels along a straight line A1 in the direction M (See FIG. 6 in conjunction with FIG. 5) from the position 360' on the membrane surface 242, it will hit the surface 442 of reflector 400 at a point denoted 360", where it may be reflected in a direction 300' towards plane P. A user/listener 205 may be positioned at plane P, as schematically indicated by an ear in FIG. 6. The distance traveled by audio wave W1' from the position 360' to the plane P is the sum of distances A1+A2. In a corresponding manner, the distance traveled by audio wave W2' from the position 370' to the plane P is the sum of distances B1+B2. Hence, audio wave W1' will travel a first distance $D_{W1'}$=A1+A2, and audio wave W2' will travel a second distance $D_{W2'}$=B1+B2.

According to an embodiment of the invention, the contour of the non-flat reflector surface 442 may be such that the first distance $D_{W1'}$ is substantially equal to the second distance $D_{W2'}$, as clearly shown in FIG. 6.

In this connection it is to be noted that the substantially straight lines A1 and A2, in FIG. 6, illustrate a path traveled by a ray W1' of sound whose starting point on the surface 242 of membrane 240 is the point denoted 360'. Similarly, the substantially straight lines B1 and B2, in FIG. 6, illustrate a path traveled by another ray W2' of sound whose starting point on the surface 242 of membrane 240 is the point denoted 370'.

Moreover, as mentioned above, a sound wave travelling through air may be described by variations in the air pressure through space and time. The air pressure value may be referred to as the amplitude of the sound wave, and the wave itself is a function specifying the amplitude at each point in the space filled with air. An arbitrary point in the plane P (See FIG. 6) is an example of such a point in space. With reference to FIG. 6, the sine wave-shaped line $W1_A'$ provides a schematic illustration of the spatial variation of the amplitude of the sound ray W1' originating at the point denoted 360' on the surface 242 of membrane 240, and the sine wave-shaped line $W2_A'$ provides a schematic illustration of the spatial variation of the amplitude of the sound ray W2' originating at the point denoted 370' on the surface 242 of membrane 240. Hence, a signal having a certain frequency f1 will exhibit a corresponding wave length λ1 as it travels through air (See FIG. 6 in conjunction with FIG. 4). For example, a 10 kHz acoustic signal travelling through air exhibits a wave length of about 34 mm, whereas a 100 Hz signal travelling through air exhibits a wave length of about 3400 mm, i.e. about 3.4 meters. As illustrated in FIG. 6, the audio generator 390, 410 may provide the advantageous effect of reducing or substantially eliminating distortion of sound caused by interference. This advantageous effect may be attained because, according to some embodiments of the invention, the contour of the non-flat reflector surface 442 is adapted to compensate for the non-flat surface (242) of the membrane 240 by substantially equalizing the distance of travel for mutually different rays of acoustic signals. This equalization may thus ensure that e.g. when plural rays, such as $W_1'$ and W2', of the acoustic signal has a certain frequency f1, hence exhibiting a corresponding wave length λ1, the amplitudes $W_{1A}'$ and $W_{1B}'$ of the acoustic signal rays will be substantially in phase with each other, as illustrated in FIG. 6.

As mentioned above, the contour of the non-flat reflector surface 400 may be adapted to compensate for the non-flatness of the surface 242 such that the first distance $D_{W1'}$ is substantially equal to the second distance $D_{W2}$. Hence, a phase deviation ϕ, between two audio waves W1' and W2', respectively, caused by the non-flat surface 242, may be substantially eliminated at an arbitrary distance D3 from the audio generator 410, since two acoustic waves W1' and W2', being created at mutually different positions 360' and 370', respectively, on the membrane 240 will have traveled substantially the same distance when they reach a plane P at a distance D3 from audio generator 390.

Hence, the phase deviation ϕ, between two audio waves W1' and W2', respectively, caused by the non-flat surface 242, may be substantially eliminated at an arbitrary distance D3 from the audio generator 410, since two acoustic waves W1' and W2', being created at mutually different positions 360' and 370', respectively, on the membrane 240 will have traveled substantially the same distance when they reach a plane P at a distance D3 from audio generator 390.

Thus, the audio generator 390, 410 (See FIGS. 5 and/or 6) may advantageously ensure that when the electric drive signal 180 includes a single electric frequency component $f_{n180}$ having a certain amplitude $A_{n180}$ for a certain duration $t_{n180}$, then the acoustic signal 200, as it appears at an arbitrary point at the plane P at a distance D3 from the baffle 230, will exhibit a corresponding single acoustic frequency component $f_{n200}$ having a certain acoustic amplitude $A_{n200}$ for a certain acoustic duration $t_{n200}$; wherein the single acoustic frequency component $f_{n200}$ will be equal to, or substantially equal to the single electric frequency component $f_{n180}$, and the certain acoustic amplitude $A_{n200}$ will correspond to, or substantially correspond to the certain amplitude $A_{n180}$, and the certain acoustic duration $t_{n200}$ will be equal to, or substantially equal to the certain duration $t_{n180}$. Hence, interference caused by superposition which inherently result from a state of the art loudspeaker having a non-flat surface may be reduced, or substantially eliminated by the use of an embodiment of an audio generator 390, 410 as described in connection with FIGS. 5 and/or 6.

FIGS. 7-11 illustrate and describe further embodiments and details of embodiments of the invention.

Figure 7A:
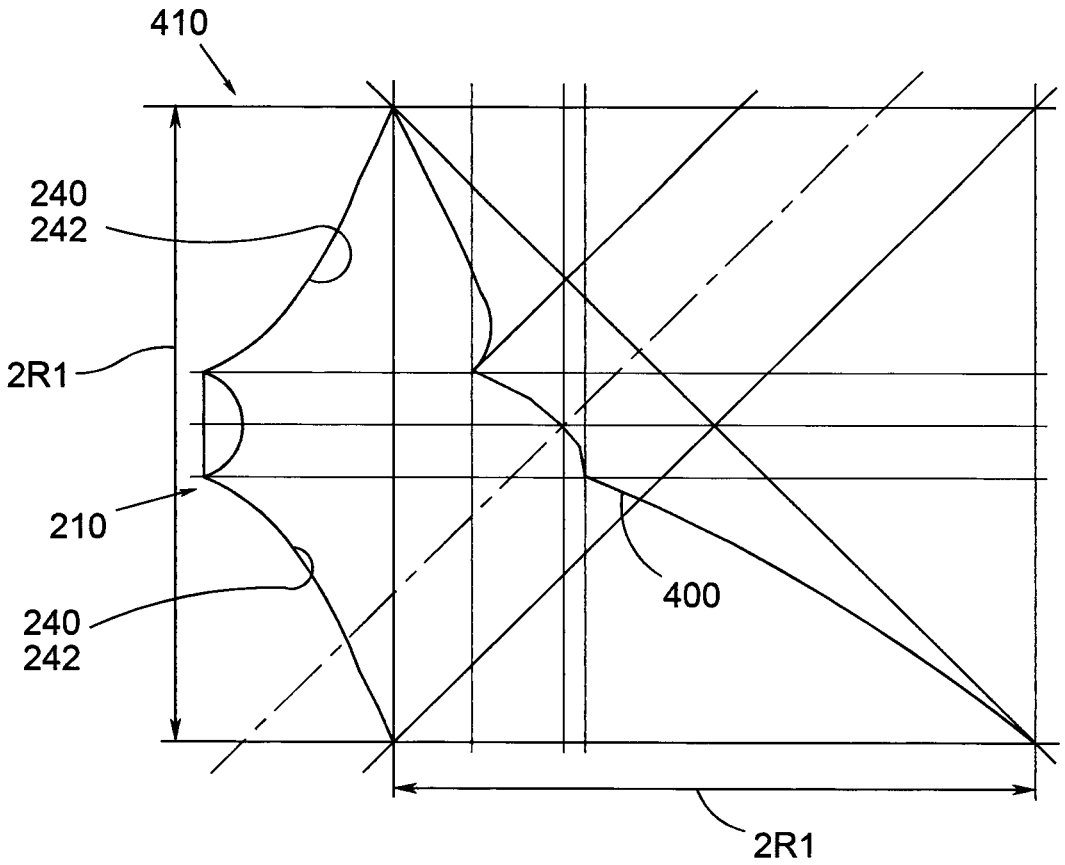
FIG. 7A is also a schematic side view of an embodiment of an audio generator.

FIG. 7A is also a schematic side view of an embodiment of an audio generator 410. The audio generator 410 may include a transducer element 210, as described in connection with FIG. 3 above. The audio generator 410 comprises a membrane 240 having a surface 242 which is non-flat, and a reflector 400, wherein the reflector 400 has a surface shape adapted to reflect audio waves propagating from the membrane surface 242 such that a phase deviation, between two audio waves, caused by said non-flat surface 242 is substantially eliminated at an arbitrary distance D3 from the audio generator 410.

Figure 7B:
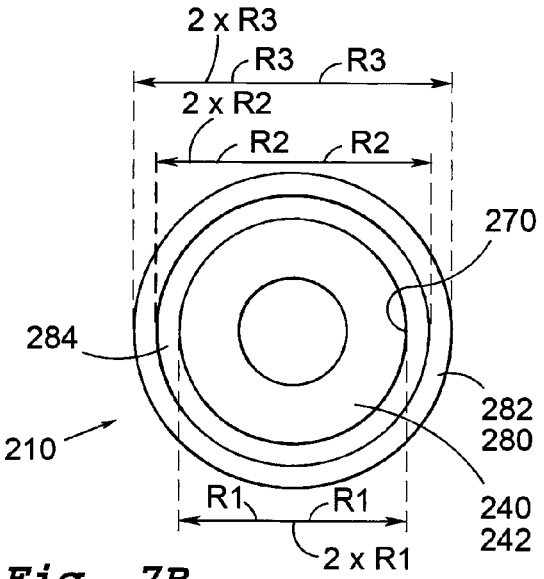
FIG. 7B is a top view of an embodiment of a transducer element.

FIG. 7B is a top view of an embodiment of a transducer element 210. The transducer element 210 illustrated in FIG. 7B may be designed substantially as described in connection with FIG. 3 above. Hence, transducer element 210 may have a membrane 240 which is movable in dependence on an electric drive signal 180. The membrane 240 has an outer perimeter 270 which may be flexibly attached to a portion 282 of the transducer element body 280.

In the embodiment of FIG. 7B, the outer perimeter 270 of the membrane 240 is circular, having a radius R1. Hence, the flexible member 284, which may be adapted to physically connect the outer perimeter 270 of the membrane 240 with a portion 282 of the transducer element body 280, may have an inner radius R1, and an outer radius R2.

Accordingly, the portion 282 of the transducer element body 280 may have an inner radius R2 and an outer radius R3, as illustrated in FIG. 7B.

Figure 7C:
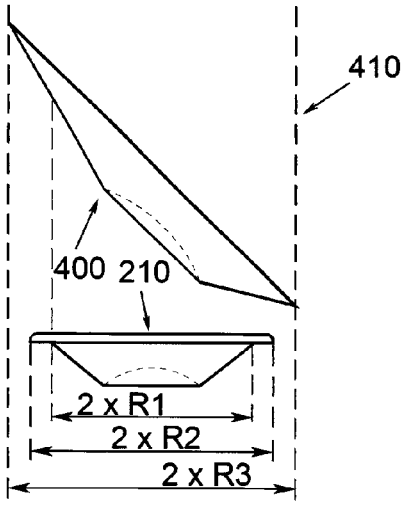
FIG. 7C is a side view of an embodiment of an audio generator 410 including a transducer element 210, as illustrated in FIG. 7B, and an embodiment of a corresponding reflector 400.

FIG. 7C is a side view of an embodiment of an audio generator 410 including a transducer element 210, as illustrated in FIG. 7B, and an embodiment of a corresponding reflector 400.

Figure 7D:
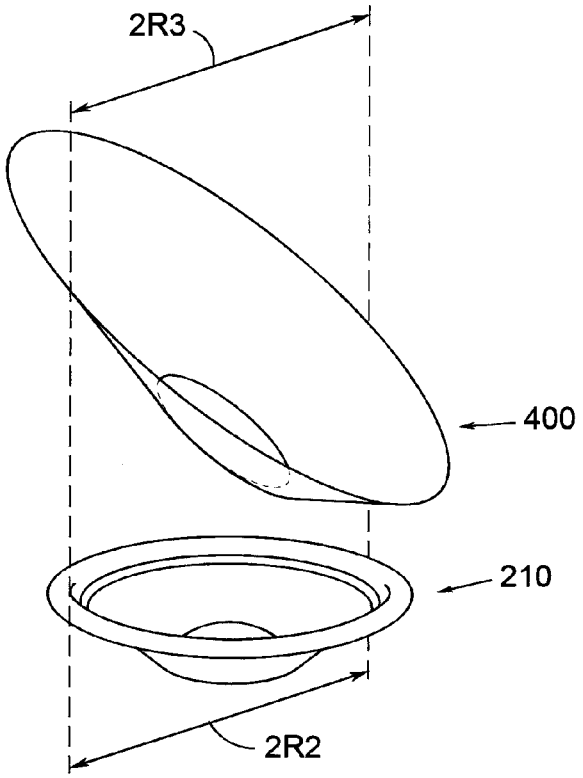
FIG. 7D is a perspective side view of the audio generator illustrated in FIG. 7C.

FIG. 7D is a perspective side view of the audio generator 410 illustrated in FIG. 7C.

A Process for Designing a Phase Adjusting Reflector

Figure 8A:
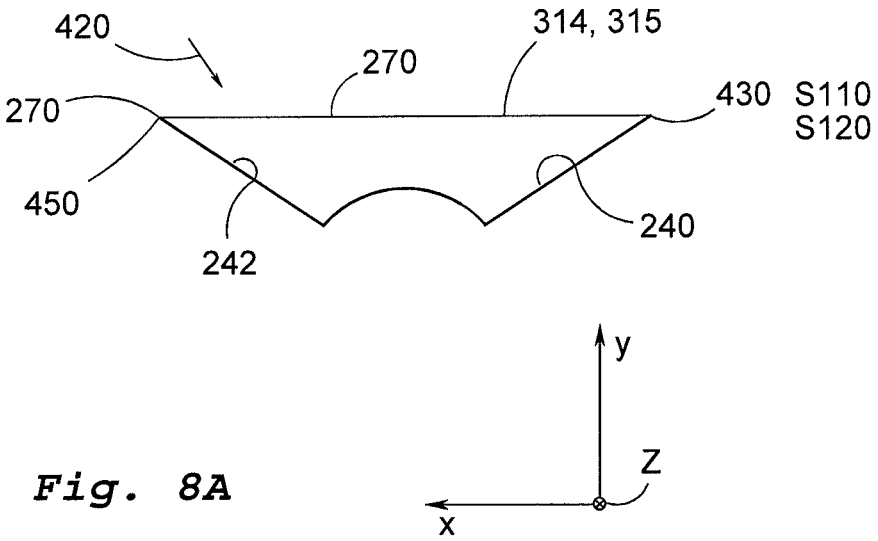
FIGS. 8A-8F illustrated an embodiment of a process for the design of an audio reflector.

An embodiment of a process for the design of an audio reflector 400 is described with reference to FIGS. 8A to 8F FIG. 8A is a schematic side view of a transducer element 210 having a membrane 240 and a first aperture 315. The first aperture 315 may be as discussed above in connection with FIGS. 3 and/or 5 and/or 6. Hence, the first aperture 315 may be defined by the outer perimeter 270 of the membrane 240. The membrane 240, according the FIG. 8A embodiment, is substantially cone shaped. Accordingly, the upper surface 242 of the membrane 240, as illustrated in FIG. 8A, may substantially have the shape of an inner surface of a truncated cone, i.e. the membrane surface 242 is curved. Hence, the curved membrane surface 242, as illustrated in FIG. 8A, is a species of a non-flat surface 242. In effect, the transducer element 210 of FIG. 8A could have a shape as illustrated in e.g. FIG. 7B.

Figure 8B:
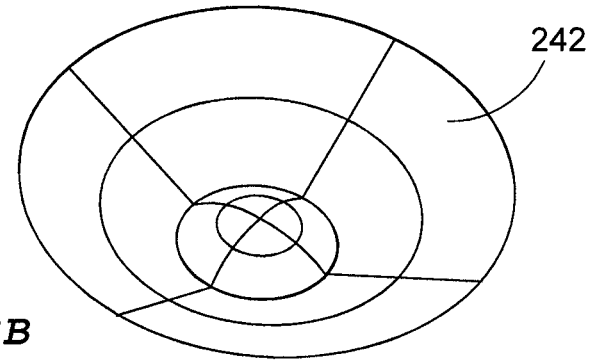

FIG. 8B is an illustration of the surface 242 of the membrane 240, shown in FIG. 8A, when seen in the direction of arrow 420.

An embodiment of a process for the design of an audio reflector 400 may start by a step S110 of establishing information describing the contour of the surface 242 of the membrane 240. This process, or parts of it, may be performed by means of a computer operating to execute a computer program.

The step S110 of establishing information describing the contour of the surface 242 may include measuring the contour of the surface 242. Such measuring of the contour of the surface 242 may include automatic measurement by means of optical scanner equipment, such as e.g. a laser scanner. Alternatively the measuring of the contour of the surface 242 may include manual measurement of the surface 242, and/or a combination of automatic measurement and manual measurement. Based on the information established in step S110, the contour of the surface 242 may be described as a number of points in a three-dimensional space. Hence, the surface 242 of the membrane 240 may be described by a plurality of points $Ps_i=(x_i, y_i, z_i)$. In this context, please refer to FIG. 8A which also illustrates a co-ordinate system having three axes representing three orthogonal dimensions x, y and z in three dimensional space.

In a subsequent step, S120, a single first selected point 430 near the outer perimeter 270 of the surface 242, or at the outer perimeter 270 of the surface 242, may be identified (see FIG. 8A). In this connection, a second point 450 is also identified. The second point 450 may be a point at a distance $D_R$ from the first selected point 430 along a straight line (See FIG. 8D). According to an embodiment, the second point 450 may be a point on the membrane 240 near the outer perimeter 270 of the surface 242, or at the outer perimeter 270 of the surface 242, when the membrane 240 is cone-shaped. When the membrane 240 is cone-shaped having a substantially circular cone base, the distance $D_R$ may be substantially twice the radius R1 of the base of the membrane 240. The membrane embodiment 240 illustrated in FIG. 8D is cone-shaped, substantially as the membrane 242 of FIGS. 7B, 7C and 7D, and hence the second point 450 may be a point on the far left hand side of the cone base, as shown in FIG. 8D, when the first selected point 430 is on the far right hand side of the cone base.

Figures 8C, 8D, 8E:
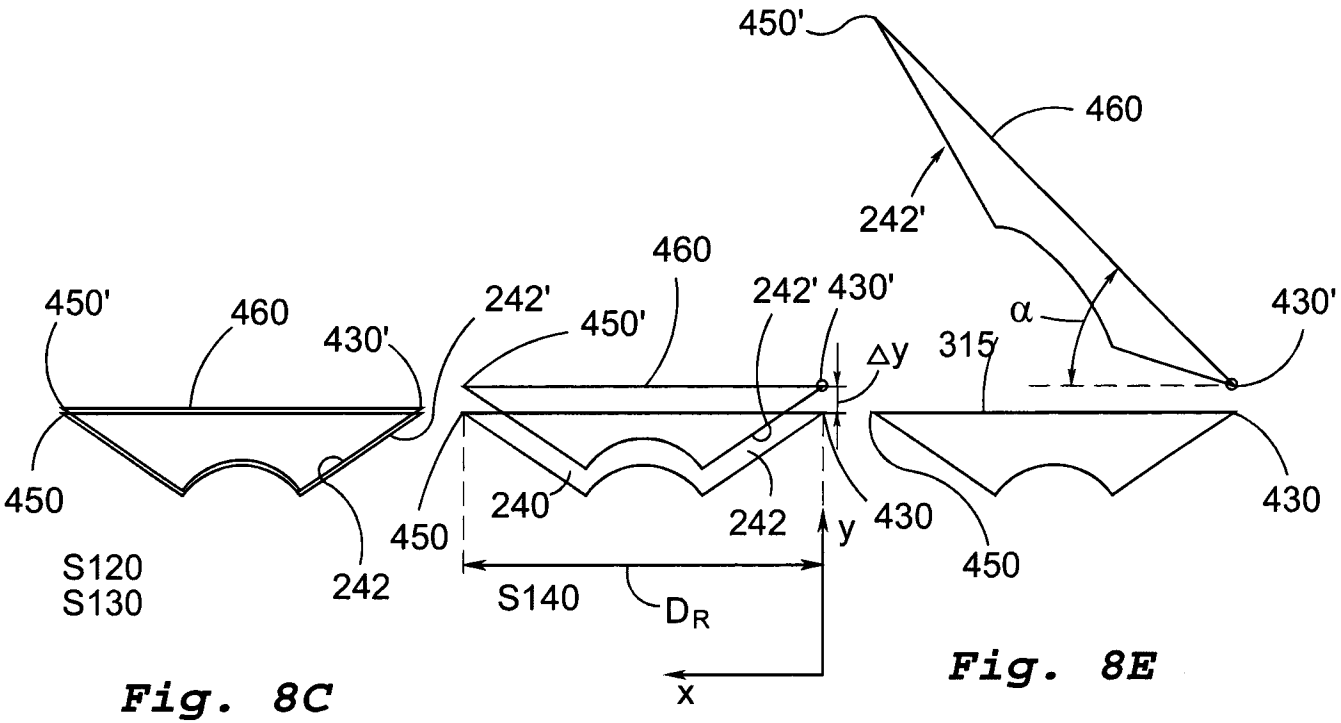

In a subsequent step, S130, the points describing the contour of the surface 242 may be copied so that a plurality of points $PS'_i=(x'_i, y'_i, z'_i)$ represent a mirror surface 242'; the mirror surface 242' as represented substantially being identical but mirror-inverted as compared to the original surface 242 (see FIG. 8C). This process may be performed by means of a computer operating to execute a computer program. The first selected point 430 is mirrored by a first mirror point 430', and the second point 450 is mirrored by a second mirror point 450'. With reference to FIGS. 8C and 8D, a line 460 may be drawn so as to connect the first mirror point 430' with the second mirror point 450'. In actual fact, the line 460 may represent a back plane of the reflector-to-be.

In a subsequent step, S140, the points describing the contour of mirror surface 242' may, optionally, be moved by a certain amount Δy in the direction of the y-axis, as illustrated in FIG. 8D. Hence, the moved mirror image, as shown in FIG. 8D, may have a coordinates $PS'_i=(x'_i, y'_i, z'_i)=(x_i, y_i+\Delta y, z_i)$. The certain amount Δy of movement in the direction of the y-axis may be set to zero.

In a step, S150, the points making up the mirror surface 242' are rotated by a certain angle α around the first selected mirror point 430', as illustrated in FIG. 8E, so that substantially all points describing the contour of mirror surface 242' are moved in the direction of the y-axis. In this step, S150, only the selected point 430' may remain at substantially unchanged position, since all other coordinate points making up the mirror surface are rotated around it. According to an embodiment, this step may be performed such that during the rotation of the mirror surface 242', the mirror surface is stretched such that an arbitrary point $PS'_i=(x'_i, y'_i, z'_i)$ of the mirror surface 242' will remain at an unchanged x-position while being moved in the y-direction.

Figure 8F:
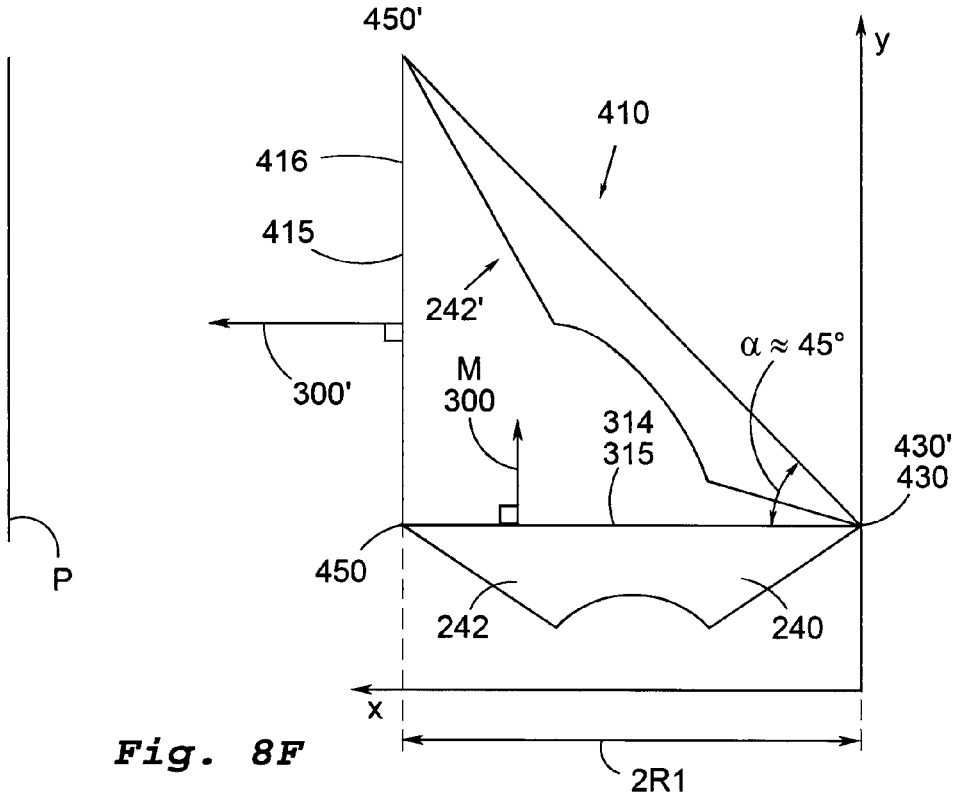

FIG. 8F is a sectioned lateral view of an embodiment of an audio generator 410 wherein the points $PS'_i=(x'_i, y'_i, z'_i)$ making up the mirror surface 242' have been rotated by a certain angle α around the selected mirror point 430'. In the FIG. 8F embodiment, the certain angle α is about 45 degrees, and the certain amount Δy is zero, i.e. there has been no uniform translation in the y-direction.

With reference to FIG. 8F, an embodiment of the audio generator 410 may comprise a first aperture 315 which is defined by the plane of the base of the substantially cone shaped membrane 240. The first aperture 315 may be as discussed above in connection with FIGS. 3 and/or 5 and/or 6 and/or FIG. 8A. Hence, in FIG. 8F the first aperture is illustrated by the line stretching from point 430 to point 450. The audio generator 410 according to the FIG. 8F embodiment also includes a second aperture 415. The plane 416 of second aperture 415 is illustrated to stretch along a straight line connecting the point 450' and the point 450, in FIG. 8F.

Sound generated by the membrane 240 may travel in the direction M, via the first aperture 315, so as to be reflected by the surface 242' of the reflector 400. Sound reflected by the surface 242' of the reflector 400 may thereafter leave the audio generator 410 via the second aperture 415 so as to travel in the direction of arrow 300' towards a plane P at a distance D3 from the plane 416 of second aperture 415. According to an embodiment, the plane P may coincide with the plane 416 of second aperture 415, when the distance D3 is very short, or substantially zero. During a typical listening session, however, the plane P where a user is likely to be positioned, may be at a distance D3 of more than one meter from the plane 416 of second aperture 415.

Figure 8G:
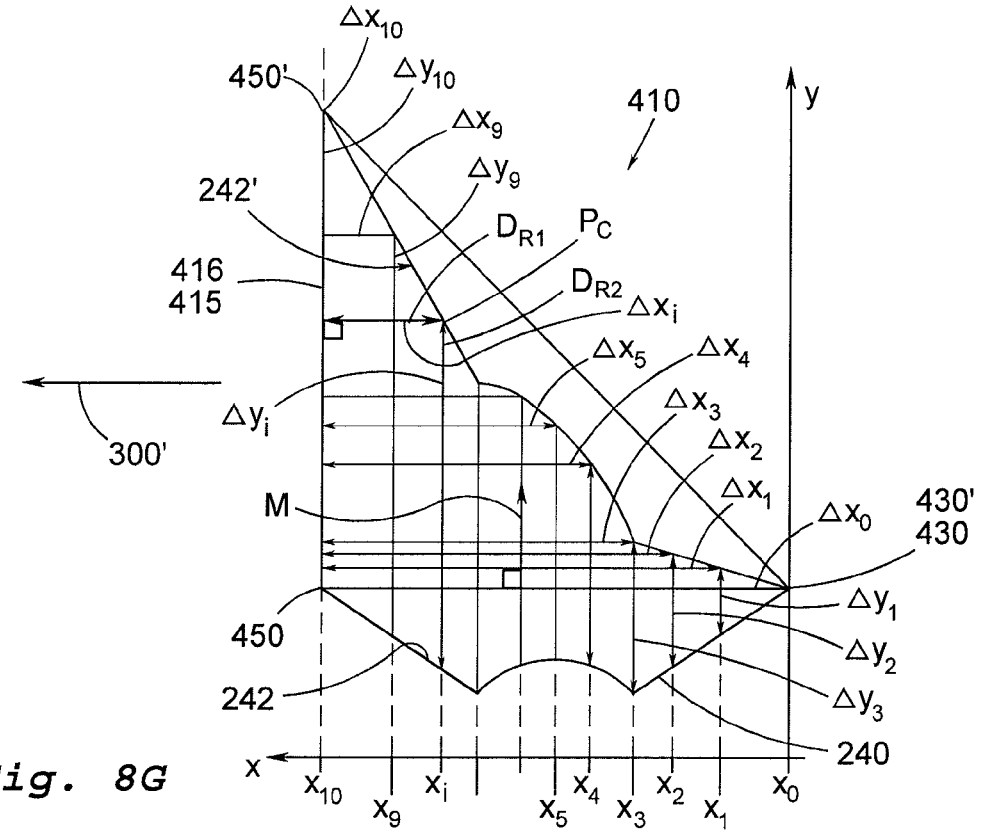
FIG. 8G is another sectioned lateral view of an audio generator.

FIG. 8G is another sectioned lateral view of the audio generator 410 of the FIG. 8F embodiment. With reference to FIG. 8G, the geometry of embodiments of the audio generator 410 will be described.

According to embodiments of the invention, the geometry of the audio generator 410 is such that a route R comprises two constituent distances: a first constituent distance R1 and a second constituent distance R2. The first constituent distance R1 is defined by a straight line (parallel to arrow 300') being orthogonal to the plane 416 of second aperture 415, and its value is the distance, along that straight line, from an arbitrary point on the plane 416 of second aperture 415 to a corresponding point $P_C$ on the non-flat surface 242' of the reflector 400 (See FIG. 8G). The second constituent distance R2 is defined by a second straight line (parallel to arrow M) being orthogonal to the plane 314 of first aperture 315, and its value is the distance, along that second straight line, from the point $P_C$ (referred to as "corresponding point") on the non-flat surface 242' of the reflector 400 to a second corresponding point on the non-flat surface 242 of the membrane 240. According to some embodiments, the audio generator 410 is such that for any two such routes $R_A$ and $R_B$ it is true that the distance $R_A$ is substantially equal to the distance $R_B$. Hence, the distance of the route $R_A$ is substantially equal to the distance of the route $R_B$, both of which are substantially equal to a constant value C. Thus, the value of the constant C may be determined by the geometry of the non-flat surface 242 of the membrane 240. According to an embodiment, the value of the constant C depends on the longest distance, along a route R as described above, from a point on the plane 416 of second aperture 415 to a corresponding point on the non-flat surface 242 of the membrane 240. When the non-flat surface 242 of the membrane 240 is substantially cone shaped, the value of the constant C may depend on the radius R1 of the membrane 240. Moreover, the value of the constant C may depend on the value of the certain amount Ay of movement, as selected in connection with step S140 of the design of the reflector, as described above.

According to some other embodiments, the audio generator 410 is such that for any two such routes $R_A$ and $R_B$ it is true that the distance $R_A$ is substantially equal to the distance $R_B$, except for routes originating or terminating substantially at the perimeter 270 of the first aperture 315. These descriptions of the geometry of the audio generator 410, 390 may be valid for a large range of angles α and for various sizes of the respective first and second apertures, and for various mutual relations of size between the first and second apertures.

The above described geometry of the audio generator 410 does not require the first constituent distance R1 and a second constituent distance R2 to be mutually orthogonal. However, according to some embodiments of the audio generator 410 the first constituent distance R1 and a second constituent distance R2 are orthogonal to each other. With reference to FIG. 8G, a number of first constituent distances R1 are illustrated as distances Δx in the direction of an x axis, and a number of second constituent distances R2 are illustrated as distances Δy.

More particularly, a number of lines Δy1, Δy2, Δy3, . . . Δyi, . . . Δy9 and Δy10 illustrate respective distances from the non-flat surface 242 of the membrane 240 to the non-flat surface 242' of the reflector 400. A number of correspondingly referenced lines Δx1, Δx2, Δx3, . . . Δxi, . . . Δx9 and Δx10 illustrate the respective distances from the points of incidence of the lines Δy1, Δy2, Δy3, . . . Δyi, . . . Δy9 and Δy10 on the surface 242' to the plane 416 of the second aperture 415. According to embodiments of the invention the geometry of the audio generator 410 is such that the sum Si of the distances xi and yi is constant:

$$Si=\Delta xi+\Delta yi=C, \text{ wherein}$$

C is a constant; and the index i is a positive integer, or zero.

Whereas high quality of sound may be produced using a single audio generator 410 as described above, it may sometimes be desired to provide plural separate electro-audio transducers for plural frequency bands included in the drive signal 180. In case two or more separate electro-audio transducers are used in an audio generator 410, these separate electro-audio transducers should be arranged so as to maintain the above mentioned conditions A) and B), according to an embodiment of the invention.

In case two or more separate electro-audio transducers having non-flat surfaces, are used: The value of the above mentioned constant C may depend on the electro-audio transducer having the largest membrane 240, or on the electro-audio transducer whose membrane 240 has the largest variation of surface non-flatness.

Figure 9:
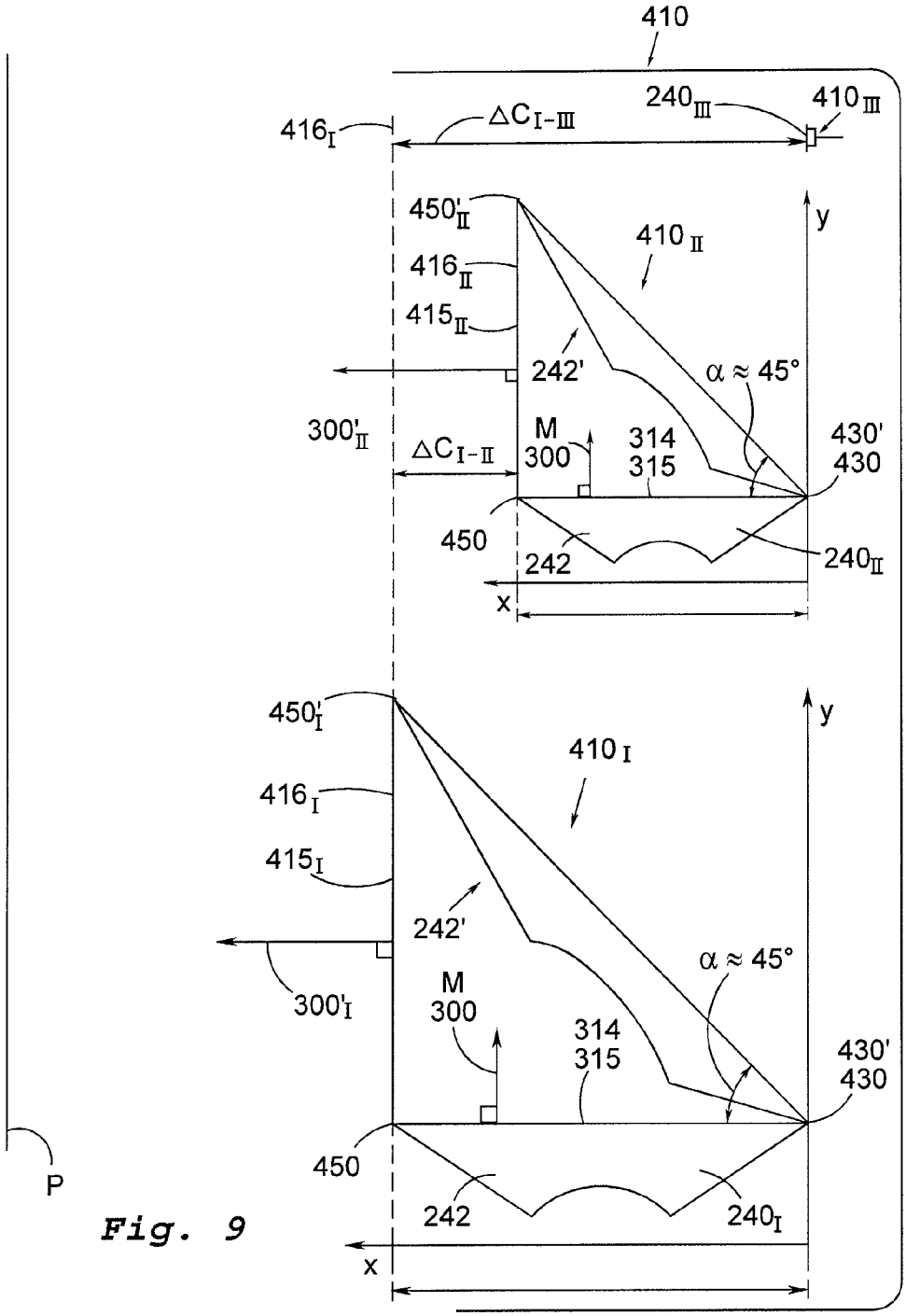
FIG. 9 illustrates an audio generator including plural electro-audio transducers $\mathbf{410}_{I}$, $\mathbf{410}_{II}$, and $\mathbf{410}_{III}$ for correctly transforming an electrical signal to a series of pressure waves.

FIG. 9 is a schematic side view of audio generator 410 comprising an example of plural electro-audio transducers of mutually different geometrical constitution. There is a first electro-audio transducer $\mathbf{410}_I$ having a first large non-flat membrane $\mathbf{240}_I$, a second electro-audio transducer $\mathbf{410}_{II}$ having a non-flat membrane $\mathbf{240}_{II}$ which is smaller than the first large membrane $\mathbf{240}_I$. Finally, there is a third electro-audio transducer $\mathbf{410}_{III}$ having a flat membrane $\mathbf{240}_{III}$.

An audio generator 410 having plural electro-audio transducers, each adapted for optimum reproduction of different frequency bands, may advantageously improve the performance of the electro-audio transducer 410 in terms of correctly reproducing a wide spectrum of frequencies that may be included in the drive signal 180.

In this connection please refer to the discussion above (in connection with FIG. 5) about conditions for regenerating an acoustic signal 200 so that it truly represents the original acoustic signal 110 (See FIG. 1) with a minimum of distortion. In particular, it is noted that the mutual temporal order of appearance, between any two signals having the different signal frequency in the original acoustic signal 110, must be maintained in the reproduced acoustic signal 200 (referred to as condition A2 above). When an original acoustic signal 110 includes two separate signal component frequencies f1 and f2, e.g. one treble signal component including a frequency f1 of 10 000 Hz and another signal component including a frequency f2 of 50 Hz, a system for reproduction of acoustic signals may attempt to reproduce this multi-component acoustic signal 110, using separate transducer elements, such as a tweeter transducer element for reproducing the high frequency component f1 and a base transducer element for reproducing the low frequency component f2.

As mentioned above, the value of the above mentioned constant C may depend on the electro-audio transducer having the largest membrane 240, or on the electro-audio transducer whose membrane 240 has the largest variation of surface non-flatness, when two or more separate electro-audio transducers are used. Hence, with reference to FIG. 9, the inventor realized that in order for an audio generator 410, including plural electro-audio transducers $\mathbf{410}_I$, $\mathbf{410}_{II}$, and $\mathbf{410}_{III}$, to correctly transform an electrical signal to a series of pressure waves (which may constitute an acoustic signal), the value of the above mentioned constant C is decided by the electro-audio transducer $\mathbf{410}_I$ having the largest membrane 240, or on the electro-audio transducer whose membrane 240 has the largest variation of surface non-flatness. In the case illustrated in FIG. 9, the decisive membrane is membrane $\mathbf{240}_I$ of the electro-audio transducer $\mathbf{410}_I$.

In a typical commercial electro-audio transducer 410 there may be provided a bass membrane $\mathbf{240}_I$, a midrange speaker membrane $\mathbf{240}_{II}$ and a treble speaker membrane $\mathbf{240}_{III}$. In such a commercial electro-audio transducer 410 the decisive membrane 240, will typically be the membrane for producing the lowest audio signals, i.e. typically referred to as bass speaker membrane, or woofer membrane. Hence, in a typical installation the membrane $\mathbf{240}_I$ of the bass speaker or woofer will be the decisive membrane $\mathbf{240}_I$. Hence, a method for producing an audio generator 410 comprising plural electro-audio transducers having membranes 240 of mutually different geometrical constitution may include the following steps:

S310: In a first step: provide plural electro-audio transducers having membranes 240 of mutually different geometrical constitution.

S320: Determine which one of the provided electro-audio transducers has the largest membrane 240, or on the electro-audio transducer whose membrane 240 has the largest variation of surface non-flatness. The selected electro-audio transducer will, in this text, be referred to as the decisive electro-audio transducer $\mathbf{410}_I$ having a decisive membrane $\mathbf{240}_I$.

S330: Determine the value of the constant C, for the decisive membrane $\mathbf{240}_I$. This may be done as discussed above in connection with FIGS. 8A to 8G. The constant thus determined will, in this text, be referred to as the decisive constant $C_I$.

S340: Select one of the remaining electro-audio transducers $\mathbf{410}_{II}$ from among the electro-audio transducers provided in step S310 having a non-flat membrane 240II. The selected electro-audio transducer will now be referred to as electro-audio transducer $\mathbf{410}_{II}$ having a non-flat membrane $\mathbf{240}_{II}$.

S350 Determine the value of the constant $C_{II}$, for the selected electro-audio transducer $\mathbf{410}_{II}$. This may also be done as discussed above in connection with FIGS. 8A to 8G. The constant thus determined will, in this text, be referred to as a dependent constant $C_{II}$ and the corresponding electro-audio transducer is referred to as the dependent electro-audio transducer 410$_{II}$. The value of the dependent constant $C_{II}$ should be smaller than the value of the decisive constant $C_I$.

S360: Determine a difference value $\Delta C_{I-II}$: The difference value may be $$\Delta C_{I-II}=C_I-C_{II}$$

S370: When designing the audio generator 410 comprising plural electro-audio transducers, the plane 416 of the dependent electro-audio transducer 410$_{II}$ should be positioned at a larger distance from the plane P than the plane 416, of the decisive electro-audio transducer 410$_I$, the difference being the determined difference value $\Delta C_{I-II}$. This is schematically illustrated in FIG. 9. Hence, the difference value $\Delta C_{I-II}$ may be expressed as a distance, e.g. in millimeters.

S380: If there is yet another electro-audio transducer provided in step S310 having a non-flat membrane 240II: then repeat steps S340 to S370.

S390: Select one of the remaining electro-audio transducers 410$_I$, from among the electro-audio transducers provided in step S310, having a flat membrane 240$_{III}$. The selected electro-audio transducer will now be referred to as flat membrane transducer 410$_{III}$. The flat membrane 240$_{III}$ of a flat membrane transducer 410$_{III}$ is such that S400: When designing the audio generator 410 comprising plural electro-audio transducers, the flat membrane 240$_{III}$ of a flat membrane transducer 410$_{III}$ should be positioned at a position so that the distance $C_{I-III}$ of propagation from flat membrane 240$_{III}$ to the extended plane 416, of second aperture 415 of the decisive electro-audio transducer 410$_I$ is substantially equal to the value of the decisive constant $C_I$ (See FIG. 9 and/or FIG. 11A). This may also be termed as follows: The flat membrane transducer 410$_{III}$ has its second aperture 415 substantially at the plane of the flat membrane 240$_{III}$, since the flat membrane 240$_{III}$ operates to generate a plane wave front. Hence, the constant C will have value zero (0) for the flat membrane transducer 410$_{III}$.

Figure 10A:
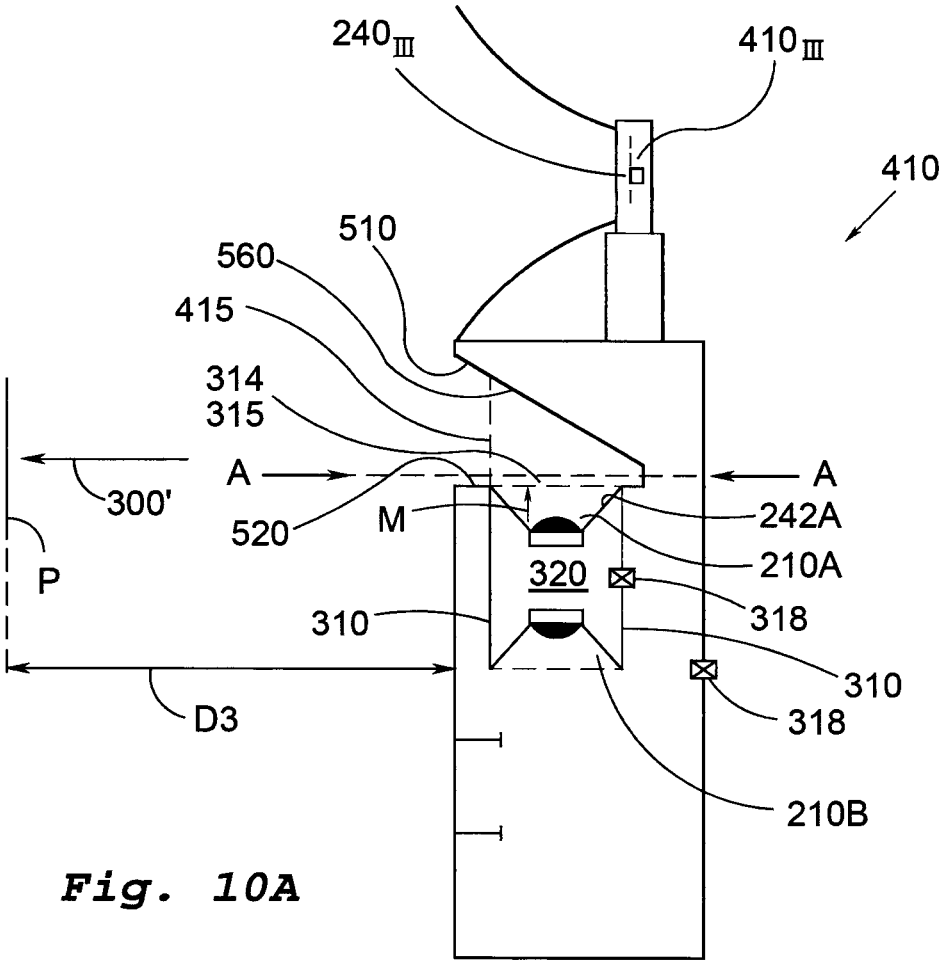
FIG. 10A is an illustration of yet an embodiment of an audio generator.

FIG. 10A is an illustration of yet an embodiment of an audio generator 410 according to the invention. The FIG. 10A embodiment includes the advantageous features of the audio generator 190 described with reference to FIGS. 2C and/or 2D with guiding walls 510, 520, 530, 540 adapted so as to cause an increased sound propagation focus in the direction 300A' towards the plane P at a distance D3 from the audio generator 410. However, the FIG. 10 embodiment differs from the FIG. 2A-2D embodiments in that the box structure 502 holds the enclosure 310, so that movement of the first membrane 240A causes sound propagation in a first direction different to the direction 300', and the upper guide means 510 has been tilted so as to cause reflection of the sound exciting from first aperture 315.

Hence, with reference to FIG. 10A, the audio generator 410 may comprise an aperture 415, a reflector 560 and directive guiding walls 510, 520, 530, 540. The reflector 560 may have a surface adapted to reflect acoustic signals. The reflector co-operates with the directive guiding walls so as to lead and guide said audio pressure waves to propagate in the direction 300' so as to propagate in a direction orthogonal to the plane of the aperture 415.

Figure 10B:
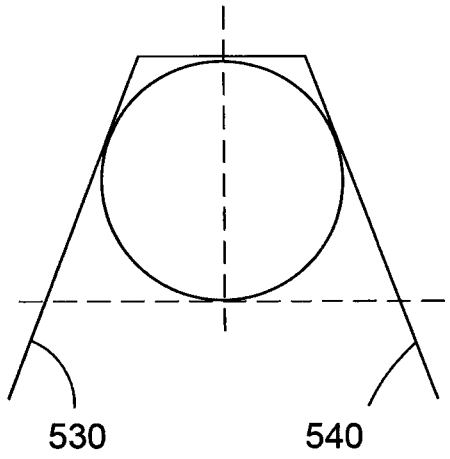
FIG. 10B is a cross-sectional top view taken along line A-A of FIG. 10A.

FIG. 10B is a schematic cross-sectional view taken along line A-A of FIG. 10A. Hence, when movement of the membrane 240A causes a momentary increase in air pressure, i.e. a pressure pulse, having a direction of propagation v in the direction M, orthogonal to the plane of the first aperture plane 315, the pressure pulse is reflected in the desired direction by reflector 560. The pressure pulses may also be maintained and directed by the directive guiding walls 510, 520, 530 and 550 so as to focus the direction of movement of the pressure pulse in the direction 300A' towards a plane P at a distance from the audio generator 410.

Since a listener 205 will typically enjoy music at a distance D3 of more than one meter, or so, from the audio generator 410, it is advantageous to have the sound (which is composed of successive controlled pressure pulses) directed.

When a plane wave front of narrow width leaves a source, it will inherently spread sideways in a manner that causes the resulting wave front to be curved at a large distance from the source. In this connection, the directive guiding walls operate to lead and guide the successive pressure pulses as they propagate from the first aperture.

FIG. 10B is a cross-sectional top view taken along line A-A of FIG. 10A.

The sound waves exciting via the second aperture 415A$_I$ may propagate into the surrounding space primarily in the direction 300A' which is orthogonal to the plane 416A$_I$ of the second aperture 415A$_I$. However, the nature of sound waves is such that they may spread somewhat also in other directions than the direction 300A'. According to an embodiment of the invention, the audio generator 410 may also include directive guiding walls so as to cause an increased sound propagation focus in the direction 300A' which is orthogonal to the plane 416A$_I$ of the second aperture 415A$_I$.

Hence, when movement of the membrane 240 causes a momentary increase in air pressure, i.e. a pressure pulse, having a direction of propagation v in the direction M, orthogonal to the plane of the first aperture plane, the pressure pulse is maintained and directed by the directive guiding walls so as to focus the direction of movement of the pressure pulse in the direction 300A' towards a plane P at a distance from the audio generator 410.

Since a listener 205 will typically enjoy music at a distance D3 of more than one meter, or so, from the audio generator 410, it is advantageous to have the sound (which is composed of successive controlled pressure pulses) directed.

Figure 11A:
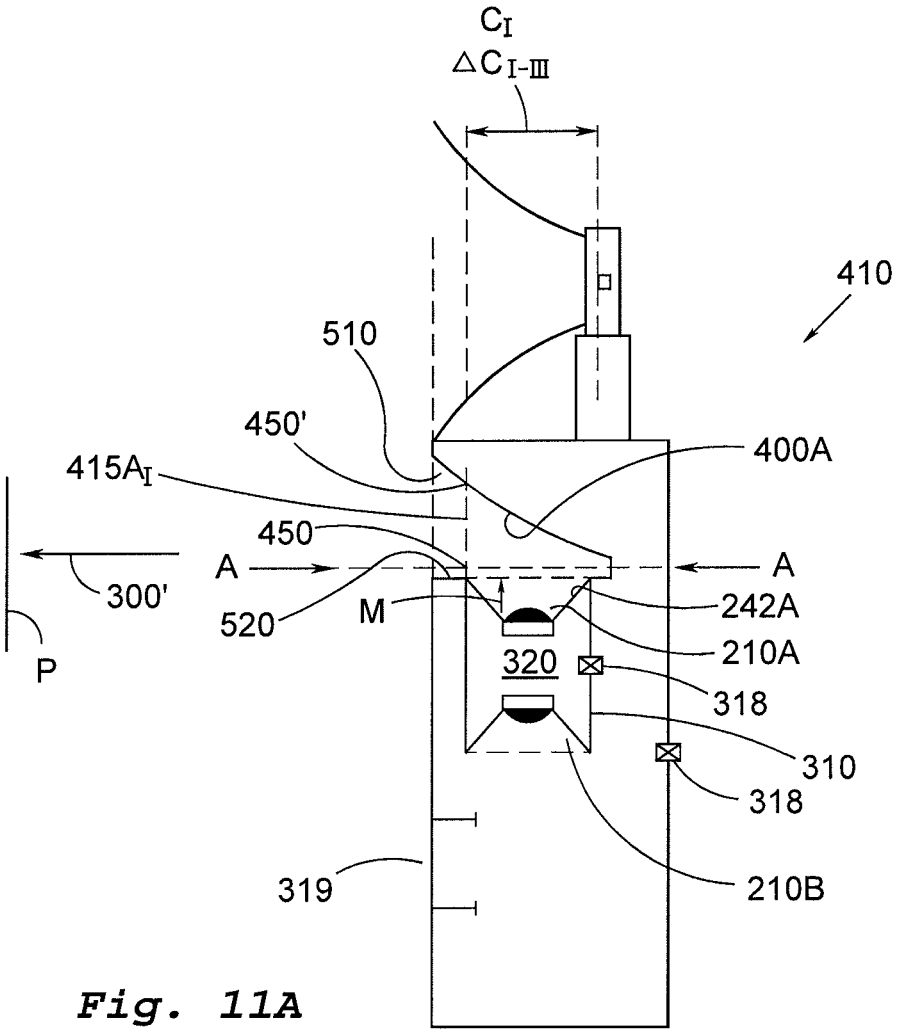
FIG. 11A is an illustration of yet an embodiment of an audio generator.

When a plane wave front of narrow width leaves a source, it will inherently spread sideways in a manner that causes the resulting wave front to be curved at a large distance from the source. In this connection, the directive guiding walls operate to lead and guide the successive pressure pulses as they propagate from the first aperture. Hence, the directive guiding walls, in the desired direction 300' whereas focused FIG. 11A is an illustration of yet an embodiment of an audio generator 410 according to the invention. The FIG. 10 embodiment combines the advantageous features of the audio generator 190 described with reference to FIGS. 10A and 10B with the additional advantageous features of the audio generator 390, 410 described with reference to FIGS. 5-9. Accordingly, FIG. 10B is also an illustration of a cross-sectional top view taken along line A-A of FIG. 11A.

The FIG. 11A audio generator 410 includes an enclosure 310 adapted to enclose a space 320 between the first transducer element 210A and the second transducer element 210B. According to an embodiment the enclosure 310 is a sealed enclosure. Hence, the enclosure 310 has a body 312 so that the body 312 cooperates with the membranes 240A and 240B so as to prevent air from flowing freely between the air volume within the enclosure 310 and the ambient air.

The two transducer elements 210A and 210B may advantageously be connected in reverse phase, as illustrated in FIG. 2A and/or as illustrated in FIG. 2B and as in FIG. 10.

The FIG. 11A audio generator 410 differs from the audio generator 190 of FIGS. 2A and 2B in that it includes a first reflector 400A. The reflector 400A may be designed as described above with reference to FIGS. 5-9. Hence, FIG. 11A audio generator 410 may include a second aperture 415A, wherein the reflector 400A co-operates with the first transducer element 210A so that sound waves leaving the second aperture 415A in a direction 300A' orthogonal to the plane 416$A_f$ of the second aperture 415A are plane waves.

Various embodiments and various parts of audio generators are disclosed below.

An embodiment 1 of the invention comprises: a transducer element (210) having a membrane (240); and means (250) for causing the membrane (240) to move in dependence on an input signal so as to cause audio waves to propagate in a direction (300, 300A, 300B) away from said membrane.

Embodiment 2. The transducer element (210) according to embodiment 1, wherein the transducer element (210) includes a permanent magnet (260) which is firmly attached to a transducer element body (280); and wherein the membrane movement generator (250) includes a coil (250) adapted to generate a magnetic field in response to reception of a drive signal.

Embodiment 3. The transducer element (210) according to embodiment 1 or 2; wherein the membrane (240) has an outer perimeter (270) which is flexibly attached to a portion (282) of the transducer element body (280).

Embodiment 4. The transducer element (210) according to any preceding embodiment; wherein The drive signal (180) may be delivered via first drive terminals (252, 252A, 252B) and second drive terminals (254, 254A, 254B); the drive terminals being electrically connected to the coil (250) by first (256) and second (258) electrical conductors, respectively.

Embodiment 5. The transducer element (210) according to embodiment 4; wherein the first (256) and second (258) electrical conductors are adapted to allow the desired movement of the membrane (240) while allowing the first drive terminals (252, 252A, 252B) and second drive terminals (254, 254A, 254B), respectively, to remain immobile in relation to the transducer element body (280).

Embodiment 6. The transducer element (210) according to any preceding embodiment; wherein the transducer element body (280) is attachable to a baffle (230).

Embodiment 7. An audio generator (410, 190) comprising:

a first transducer element (210A) being mounted such that the first transducer element (210A) can cause audio waves to propagate in a first direction (300A);

a second transducer element (210B) being mounted such that the second transducer element (210B) may cause audio waves to propagate in a second direction (300B) which is different to the first direction (300A);

an enclosure (310) adapted to enclose a space (320) between the first transducer element (210A) and the second transducer element (210B).

Embodiment 8. The audio generator (410, 190) according to embodiment 7; wherein the first transducer element (210A) and/or the second transducer element (210B) is/are as defined in any of embodiments 1-6.

Embodiment 9. The audio generator (410, 190) according to embodiment 7 or 8; wherein the second direction (300B) is opposite to the first direction (300A).

Embodiment 10. An audio generator (410, 190) comprising:

a membrane (240) having a surface (242) which is non-flat, and a reflector (400), wherein the reflector (400) has a surface shape adapted to reflect audio waves propagating from the membrane surface such that a phase deviation, between two audio waves, caused by said non-flat surface (242) is substantially eliminated at an arbitrary distance (D3) from the audio generator (410).

Embodiment 11. An audio generator (410, 190) comprising: a transducer element (210) according to any preceding embodiment, wherein the membrane (240) has a surface (242) which is non-flat; the audio generator (410, 190) further comprising:

a reflector (400), wherein the reflector (400) has a surface shape adapted to reflect audio waves propagating from the membrane surface such that a phase deviation, between two audio waves, caused by said non-flat surface (242) is substantially eliminated at an arbitrary distance (D3) from the audio generator (410).

Embodiment 12. The audio generator (410, 190) according to any preceding embodiment, further comprising: a baffle (230).

Embodiment 13. The audio generator (410, 190) according to any preceding embodiment when dependent on embodiment 7; wherein the enclosure (310) is a sealed enclosure.

Embodiment 14. The audio generator (410, 190) according to any preceding embodiment, wherein the two transducer elements (210A, 210B) are connected in reverse phase.

Embodiment 15. The audio generator (410, 190) according to any preceding embodiment, wherein the two transducer elements (210A, 210B) are connected in series.

Embodiment 16. The audio generator (410, 190) according to any preceding embodiment, wherein the two transducer elements (210A, 210B) are connected in parallel.

Embodiment 17. The audio generator (410, 190) according to any preceding embodiment, wherein the two transducer elements (210A, 210B) are connected such that when the first membrane (240A) moves in the first direction (300A), then also second membrane (240B) moves in the first direction (300A).

Embodiment 18. An audio generator (410) comprising:

a membrane (240) having a surface (242) which is non-flat, a baffle (230); and a reflector (400), wherein the reflector (400) has a surface shape adapted to reflect audio waves propagating from the membrane surface such that a phase deviation, between two audio waves, caused by said non-flat surface (242) is substantially eliminated at an arbitrary distance (D3) from the audio generator (410).

Embodiment 19. The audio generator (410, 190) according to any preceding embodiment, further comprising a reflector (400), wherein the reflector (400) has a surface shape adapted to reflect audio waves (W1', W2') propagating from the membrane surface such that when said reflected audio waves (W1', W2') reach a plane (P) at a distance (D3) from the audio generator (410) said reflected audio waves (W1', W2') have traveled a substantially equal distance irrespective of from which parts of the membrane surface the audio waves (W1', W2') originate.

Embodiment 20. The audio generator (410, 190) according to any preceding embodiment, further comprising:

a treble unit adapted to generate at least one treble audio wave.

Embodiment 21. The audio generator (410, 190) according to embodiment 20, wherein:

said treble unit being adapted to generate said treble audio wave so that said treble audio wave is in phase with said two audio waves caused by said non-flat surface (242) at a distance (D3) from the audio generator (410).

Embodiment 22. The audio generator (410, 190) according to embodiment 20 or 21, wherein:

said treble unit is positioned at certain distance behind said baffle.

Embodiment 23. The audio generator (410, 190) according to any preceding embodiment, wherein said distance (D3) is a distance much larger than the surface deviation of said non-flat surface.

The invention claimed is:

1. An audio generator including a box structure comprising:

a first transducer element having a first membrane and first drive terminals for receiving a drive signal; said first transducer element being mounted such that the first transducer element can cause first audio pressure waves to propagate in a first direction in dependence on said drive signal;

a second transducer element having a second membrane and second drive terminals for receiving said drive signal, said second transducer element being mounted such that the second transducer element can cause second audio pressure waves to propagate in a second direction which is different to the first direction in dependence on said drive signal; and an enclosure adapted to enclose a first space between the first transducer element and the second transducer element;

wherein the first transducer element and the second transducer element are connected in reverse phase so that the second membrane interacts with the first membrane to reduce or eliminate air pressure variations within said first space;

wherein the first membrane has a surface which is non-flat, the first membrane having an outer perimeter which is flexibly attached to a portion of a transducer element body; said outer perimeter defining a first aperture having a first aperture plane; and wherein, in operation, the first membrane is adapted to cause said first audio pressure waves to propagate in the first direction orthogonal to said first aperture plane;

wherein said box structure further comprises:

an inside cavity comprising a second space different from the first space, wherein said second audio pressure waves are released into the second space;

a second aperture;

a reflector having a surface adapted to reflect acoustic signals; and directive guiding walls;

wherein the box structure holds the first transducer element, the reflector, and the directive guiding walls, so that the reflector co-operates with the directive guiding walls so as to lead and guide said first audio pressure waves to propagate in a third direction orthogonal to a plane of said second aperture; said third direction being different from said first direction; and wherein the acoustically reflective surface has a non-flat contour.

2. The audio generator according to claim 1, wherein the non-flat contour of the acoustically reflective surface is shaped such that a point on that surface is positioned at a first distance, along a first straight line in said third direction orthogonal to the plane of the second aperture, from the plane of said second aperture; and at a second distance, along a second straight line orthogonal to the plane of the first aperture, from a corresponding point on the non-flat surface of the first membrane.

3. The audio generator according to claim 1, wherein said reflector is arranged so that one part of the reflector is positioned a larger distance from said second aperture, and at a shorter distance from the non-flat surface of the first membrane; and another part of the reflector is positioned a shorter distance from the plane of said second aperture, and at a longer distance from the non-flat surface of the first membrane.

4. The audio generator according to claim 1, wherein the contour of the non-flat reflector surface is adapted to compensate for the non-flat surface of the first membrane by reducing or eliminating a difference in distances of propagation for mutually different rays of acoustic signals originating from mutually different points of origin on the first membrane surface and propagating in said third direction when said distances of propagation are measured from said mutually different points of origin to the plane of the second aperture.

5. The audio generator according to claim 1; wherein said enclosure comprises means for air pressure equalization.

6. The audio generator according to claim 1, wherein said enclosure is a first enclosure, and said box structure forms a second enclosure within which said first enclosure is held.

7. The audio generator according to claim 1, wherein said second aperture plane is a flat plane.

8. The audio generator according to claim 1, wherein said reflector is arranged in a tilted position in relation to the first aperture of the first membrane so that a first edge part of the reflector is positioned at a third distance, along said first direction, from the first aperture while a second edge part of the reflector is positioned at a fourth distance, along said first direction, from the first aperture;

wherein said third distance is shorter than said fourth distance such that said first edge part is positioned closer to the first aperture than said second edge part; and wherein said tilted position corresponds to a certain angle such that said reflector causes reflection of said first audio pressure waves in said third direction.

9. The audio generator according to claim 1; wherein the contour of the non-flat reflector surface is defined in dependence on the contour of the non-flat surface of the first membrane.

10. The audio generator according to claim 1; wherein the contour of the non-flat reflector surface is defined in dependence on an inverted mirror-image of the contour of the non-flat surface of the first membrane.

11. The audio generator according to claim 1; wherein the contour of the non-flat reflector surface is defined in dependence on the contour of the non-flat surface of the first membrane such that the contour of the non-flat reflector surface corresponds to an inverted mirror-image of the contour of the non-flat surface of the first membrane; wherein the inverted mirror-image is stretched such that a mirror-image point on the tilted reflector surface is positioned at a distance, along said first direction, from the corresponding point on the non-flat reflector surface.

12. The audio generator according to claim 1, wherein the directive guiding walls include side walls adapted to cause an increased sound propagation focus in said third direction by reducing a sideways spreading of said first audio pressure waves.

13. The audio generator according to claim 2; wherein the non-flat surface of the first membrane is in the shape of a truncated cone; and the sum of the first distance and the second distance is a constant value for two separate points on the cone-shaped surface of the first membrane when the two separate points are on opposite sides of a center point of the truncated cone membrane, and at mutually different distances from said truncated cone membrane center point.

14. The audio generator according to claim 2, wherein said corresponding point on the non-flat surface of the first membrane is a point on the surface of the first membrane within the outer perimeter.

15. The audio generator according to claim 2, wherein said first membrane has a circular outer perimeter; said perimeter being describable by means of a radius of said circular outer perimeter; and wherein the value of said constant depends on said first membrane outer perimeter radius.

16. The audio generator according to claim 2, wherein said first straight line in said third direction is orthogonal to the direction of the second straight line.

17. The audio generator according to claim 6, wherein said second enclosure comprises means for air pressure equalization.

18. The audio generator according to claim 13; wherein the first membrane has an inner borderline defined by the truncation of the truncated cone shape, and wherein said corresponding point on the non-flat surface of the first membrane is a point on the surface of the first membrane between the inner borderline and the outer perimeter.

19. An audio generator comprising:

a first transducer element having a first membrane and first drive terminals for receiving a drive signal; said first transducer element being mounted such that the first transducer element can cause first audio pressure waves to propagate in a first direction in dependence on said drive signal;

a second transducer element having a second membrane and second drive terminals for receiving said drive signal, said second transducer element being mounted such that the second transducer element can cause second audio pressure waves to propagate in a second direction which is different to the first direction in dependence on said drive signal; and an enclosure adapted to enclose a first space between the first transducer element and the second transducer element;

wherein the first transducer element and the second transducer element are connected in reverse phase so that the second membrane interacts with the first membrane to reduce or eliminate air pressure variations within said first space;

wherein the first membrane has an outer perimeter which is flexibly attached to a portion of a first transducer element body; said outer perimeter defining a first aperture having a first aperture plane; and wherein, in operation, the first membrane is adapted to cause said first audio pressure waves to propagate in said first direction orthogonal to said first aperture plane;

wherein said audio generator further comprises a second aperture having a second aperture plane, a reflector having a surface adapted to reflect acoustic signals, and directive guiding walls;

wherein the reflector co-operates with the directive guiding walls so as to lead and guide said first audio pressure waves to propagate in a third direction orthogonal to said second aperture plane, said third direction being different from said first direction, and said third direction being different from said second direction.

20. The audio generator according to claim 19, wherein: the first membrane has a surface which is non-flat, and wherein the reflector surface is non-flat; the contour of the non-flat reflector surface being adapted to compensate for the non-flat surface of the membrane by reducing or eliminating a difference in distances of travel for two mutually different rays of acoustic signals when said two mutually different rays of acoustic signals propagate in the third direction and when said two mutually different rays of acoustic signals have propagated past said second aperture plane.

21. The audio generator according to claim 19; wherein said enclosure comprises means for air pressure equalization.

22. The audio generator according to claim 19, wherein said second aperture plane is a flat plane.

23. The audio generator according to claim 19, wherein said reflector is arranged in a tilted position in relation to the first aperture of the first membrane so that a first edge part of the reflector is positioned at a third distance, along said first direction, from the first aperture while a second edge part of the reflector is positioned at a fourth distance, along said first direction, from the first aperture;

wherein said third distance is shorter than said fourth distance such that said first edge part is positioned closer to the first aperture than said second edge part; and wherein said tilted position corresponds to a certain angle such that said reflector causes reflection of said first audio pressure waves in said third direction.

24. The audio generator according to claim 19, wherein the directive guiding walls include side walls adapted to cause an increased sound propagation focus in said third direction by reducing a sideways spreading of said first audio pressure waves.

25. The audio generator according to claim 20 wherein: the non-flat contour of the acoustically reflective surface is shaped such that a point on the surface is positioned at a first distance, along a first straight line in said second direction orthogonal to the plane of the second aperture, from the plane of said second aperture and at a second distance, along a second straight line orthogonal to the plane of the first aperture, from a corresponding point on the non-flat surface of the membrane.

26. The audio generator according to claim 23; wherein the first membrane has a surface which is non-flat, and wherein the reflector surface is non-flat, the contour of the non-flat reflector surface being defined in dependence on the contour of the non-flat surface of the first membrane.

27. The audio generator according to claim 23; wherein the first membrane has a surface which is non-flat, and wherein the reflector surface is non-flat, the contour of the non-flat reflector surface being defined in dependence on an inverted mirror-image of the contour of the non-flat surface of the first membrane.

28. The audio generator according to claim 23; wherein the first membrane has a surface which is non-flat, and wherein the reflector surface is non-flat, the contour of the non-flat reflector surface being defined in dependence on the contour of the non-flat surface of the first membrane such that the contour of the non-flat reflector surface corresponds to an inverted mirror-image of the contour of the non-flat surface of the first membrane; wherein the inverted mirror-image is stretched such that a mirror-image point on the tilted reflector surface is positioned at a distance, along said first direction, from the corresponding point on the non-flat reflector surface.

29. The audio generator according to claim 25; wherein the non-flat surface of the first membrane is in the shape of a truncated cone; and the sum of the first distance and the second distance is a constant value for two separate points on the non-flat surface of the first membrane when the two separate points are on opposite sides of a center point of the truncated cone membrane, and at mutually different distances from said truncated cone membrane center point.

30. An electro-audio transducer comprising:

a primary audio generator having:

a primary first transducer element having a primary first membrane and primary first drive terminals for receiving a drive signal; said primary first transducer element being mounted such that the primary first transducer element can cause primary first audio pressure waves to propagate in a primary first direction in dependence on said drive signal;

a primary second transducer element having a primary second membrane and primary second drive terminals for receiving said drive signal, said primary second transducer element being mounted such that the primary second transducer element can cause primary second audio pressure waves to propagate in a primary second direction which is different to the primary first direction in dependence on said drive signal; and a primary enclosure adapted to enclose a primary space between the primary first transducer element and the primary second transducer element;

wherein the primary first transducer element and the primary second transducer element are connected in reverse phase so that the primary second membrane interacts with the primary first membrane to reduce or eliminate air pressure variations within said enclosed primary space; and wherein the primary first membrane has a primary outer perimeter which is flexibly attached to a portion of a primary first transducer element body; said primary outer perimeter defining a primary first aperture having a primary first aperture plane; and wherein, in operation, the primary first membrane is adapted to cause said primary first audio pressure waves to propagate in said primary first direction orthogonal to said primary first aperture plane;

wherein said primary audio generator further comprises a primary second aperture having a primary second aperture plane, a primary reflector having a surface adapted to reflect acoustic signals, and primary directive guiding walls;

wherein the primary reflector co-operates with the primary directive guiding walls so as to lead and guide said primary first audio pressure waves to propagate in a third direction orthogonal to said primary second aperture plane, said third direction being different from said primary first direction;

said electro-audio transducer further comprising:

a secondary audio generator having a secondary first transducer element having a secondary first membrane and secondary first drive terminals for receiving a drive signal; said secondary first transducer element being mounted such that the secondary first transducer element can cause secondary first audio pressure waves to propagate in a secondary first direction in dependence on said drive signal;

a secondary second transducer element having a secondary second membrane and secondary second drive terminals for receiving said drive signal, said secondary second transducer element being mounted such that the secondary second transducer element can cause secondary second audio pressure waves to propagate in a secondary second direction which is different to the secondary first direction in dependence on said drive signal; and a secondary enclosure adapted to enclose a secondary space between the secondary first transducer element and the secondary second transducer element;

wherein the secondary first transducer element and the secondary second transducer element are connected in reverse phase so that the secondary second membrane interacts with the secondary first membrane to reduce or eliminate air pressure variations within said enclosed secondary space; and wherein the secondary first membrane has a secondary outer perimeter which is flexibly attached to a portion of a secondary first transducer element body; said secondary outer perimeter defining a secondary first aperture having a secondary first aperture plane; and wherein, in operation, the secondary first membrane is adapted to cause said secondary first audio pressure waves to propagate in said secondary first direction orthogonal to said secondary first aperture plane;

wherein said secondary audio generator further comprises:

a secondary second aperture having a secondary second aperture plane, a secondary reflector having a surface adapted to reflect acoustic signals, and secondary directive guiding walls;

wherein the secondary reflector co-operates with the secondary directive guiding walls so as to lead and guide said secondary first audio pressure waves to propagate in said third direction orthogonal to said secondary second aperture plane;

wherein the primary first membrane has a primary first surface width, and the secondary first membrane has a secondary first surface width, said primary first surface width being larger than said secondary first surface width, and wherein said secondary second aperture plane is displaced in relation to the primary second aperture plane.

31. The electro-audio transducer according to claim 30, wherein said primary first surface width is larger than said secondary first surface width; wherein the distance of displacement depends on a relation between said primary first surface width and said secondary first surface width.

32. The electro-audio transducer according to claim 30, wherein:

the primary audio generator has a decisive sum value, and the secondary audio generator has a dependent sum value;

wherein the distance of displacement depends on a relation or a difference between said decisive sum value and said dependent sum value.

33. An electro-audio transducer including a box structure comprising:

a primary audio generator having:

a primary first transducer element having a primary first membrane and primary first drive terminals for receiving a drive signal; said first transducer element being mounted such that the primary first transducer element can cause primary first audio pressure waves to propagate in a primary first direction in dependence on said drive signal;

a primary second transducer element having a primary second membrane and second drive terminals for receiving said drive signal, said primary second transducer element being mounted such that the primary second transducer element can cause primary second audio pressure waves to propagate in a primary second direction which is different to the primary first direction in dependence on said drive signal; and a primary enclosure adapted to enclose a primary space between the primary first transducer element and the primary second transducer element;

wherein the primary first transducer element and the primary second transducer element are connected in reverse phase so that the primary second membrane interacts with the primary first membrane to reduce or eliminate air pressure variations within said enclosed primary space; and wherein the primary first membrane has a surface which is non-flat, the primary first membrane having a primary outer perimeter which is flexibly attached to a portion of a primary first transducer element body; said outer perimeter defining a primary first aperture having a primary first aperture plane; and wherein, in operation, the primary first membrane is adapted to cause said primary first audio pressure waves to propagate in the primary first direction orthogonal to said primary first aperture plane;

wherein said box structure further comprises:

a primary second aperture;

a primary reflector having a surface adapted to reflect acoustic signals; and primary directive guiding walls; and wherein the box structure holds the primary first transducer element, the primary reflector, and the primary directive guiding walls so that the primary reflector co-operates with the primary directive guiding walls so as to lead and guide said primary first audio pressure waves to propagate in a third direction orthogonal to a plane of said primary second aperture; said third direction being different from said primary first direction; and wherein the acoustically reflective surface of said primary reflector has a non-flat contour;

wherein said electro-audio transducer further comprises:

a secondary audio generator having:

a secondary first transducer element having a secondary first membrane and secondary first drive terminals for receiving a drive signal; said secondary first transducer element being mounted such that the secondary first transducer element can cause secondary first audio pressure waves to propagate in a secondary first direction in dependence on said drive signal;

a secondary second transducer element having a secondary second membrane and second drive terminals for receiving said drive signal, said secondary second transducer element being mounted such that the secondary second transducer element can cause secondary second audio pressure waves to propagate in a secondary second direction which is different to the secondary first direction in dependence on said drive signal; and a secondary enclosure adapted to enclose a secondary space between the secondary first transducer element and the secondary second transducer element;

wherein the secondary first transducer element and the secondary second transducer element are connected in reverse phase so that the secondary second membrane interacts with the secondary first membrane to reduce or eliminate air pressure variations within said enclosed secondary space; and wherein the secondary first membrane has a surface which is non-flat, the secondary first membrane having a secondary outer perimeter which is flexibly attached to a portion of a secondary first transducer element body; said outer perimeter defining a secondary first aperture having a secondary first aperture plane; and wherein, in operation, the secondary first membrane is adapted to cause said secondary first audio pressure waves to propagate in the secondary first direction orthogonal to said secondary first aperture plane;

wherein said box structure further comprises:

a secondary second aperture;

a secondary reflector having a surface adapted to reflect acoustic signals; and secondary directive guiding walls; and wherein the box structure holds the secondary first transducer element, the secondary reflector, and the secondary directive guiding walls so that the secondary reflector co-operates with the secondary directive guiding walls so as to lead and guide said secondary first audio pressure waves to propagate in said third direction orthogonal to a plane of said secondary second aperture; said third direction being different from said secondary first direction;

wherein the acoustically reflective surface of said secondary reflector has a non-flat contour;

wherein the primary first membrane has a primary first surface width, and the secondary first membrane has a secondary first surface width, said primary first surface width being larger than said secondary first surface width, and wherein the primary audio generator has a decisive second aperture, and the second audio generator has a dependent second aperture; and the plane of the dependent second aperture is displaced in relation to the plane of the decisive second aperture.

34. The electro-audio transducer according to claim 33, wherein said primary first surface width being larger than said secondary first surface width; and wherein the distance of displacement depends on a relation between said primary first surface width and said secondary first surface width.

35. The electro-audio transducer according to claim 33, wherein the primary audio generator has a decisive sum value, and the secondary audio generator has a dependent sum value; and wherein the distance of displacement depends on a relation or a difference between said decisive sum value and said dependent sum value.

* * * * *